US010920405B1

(12) United States Patent
Reidel et al.

(10) Patent No.: US 10,920,405 B1
(45) Date of Patent: Feb. 16, 2021

(54) FOOD WASTE DISPOSER INTERLOCK DEVICE

(71) Applicant: Mountain Accessories, Inc., Irving, TX (US)

(72) Inventors: Bruce Reidel, Shady Shores, TX (US); Oran Baldwin, III, Richardson, TX (US)

( * ) Notice: Subject to any disclaimer, the term of this patent is extended or adjusted under 35 U.S.C. 154(b) by 0 days.

(21) Appl. No.: 16/525,545

(22) Filed: Jul. 29, 2019

(51) Int. Cl.
*E03C 1/266* (2006.01)

(52) U.S. Cl.
CPC ..... *E03C 1/2665* (2013.01)

(58) Field of Classification Search
CPC ..... E03C 1/2665; A47J 43/075; B02C 23/04; B02C 13/31; A21C 1/148
See application file for complete search history.

(56) References Cited

U.S. PATENT DOCUMENTS 2,619,654 A * 12/1952 Coss ..... E03C 1/2665 241/32.5
3,194,505 A * 7/1965 Spackman ..... E03C 1/2665 241/194
3,409,234 A * 11/1968 Smith ..... E03C 1/2665 241/32.5
3,430,871 A * 3/1969 Ross ..... E03C 1/2665 241/32.5
8,584,977 B2 * 11/2013 Park ..... B02C 18/0092 241/46.013
2004/0178289 A1 * 9/2004 Jara-Almonte ..... E03C 1/2665 241/46.016

* cited by examiner

*Primary Examiner* — Teresa M Ekiert
*Assistant Examiner* — Sarkis A Aktavoukian
(74) *Attorney, Agent, or Firm* — Harvey Lunenfeld

(57) ABSTRACT

An interlock device coupled to a magnetically activated switch when the interlock device is removably seated in a sink flange coupled to a food waste disposer, comprising: a base having interlock device magnets, a recessed seat having drain holes, a helical cam, a strainer basket adjoined to a rotatably mounted spindle having a handle adjoined thereto, opposing nubs, which travel within the helical cam, when the handle is twisted, a spindle mounted seal adapted to block flow through the interlock device, when the spindle mounted seal is releasably seated in the recessed seat, and allowing fluid to flow through the interlock device, when the spindle mounted seal is releasably unseated from the recessed seat; the interlock device activating the food waste disposer when the interlock device is removably seated in the sink flange and one of the interlock device magnets is adjacent a switch magnet of the magnetically activated switch.

1 Claim, 29 Drawing Sheets

FOOD WASTE DISPOSER INTERLOCK DEVICE

BACKGROUND OF THE INVENTION

Field of the Invention

The present invention relates generally to food waste disposers and more particularly to batch feed food waste disposer interlock devices.

Background Art

A food waste disposer, sometimes called a garbage disposal unit, is typically electrically powered and installed under a kitchen sink between the sink's drain and trap. Food fed into the food waste disposer is shredded into small pieces, often less than a few millimeters in size. The shredded food waste is then passed through a home's plumbing system for downstream disposal into existing infrastructure, such as, for example, sewage systems and wastewater treatment plants.

A typical food waste disposer has a high starting torque electric motor, which drives a turntable inside a grinding chamber into which food waste drops. Swiveling metal impellers near a top edge of the turntable throw the food waste against a grinding ring repeatedly, until the food waste is small enough to pass through an opening in a ring, allowing the food waste to be flushed down the sink drain.

The food waste disposer was invented by John W. Hammes, a Racine, Wis. architect, in 1927, who applied for a patent in 1933 that was issued in 1935 as U.S. Pat. No. 2,012,680 (Hammes). Mr. Hammes put his invention into practice in 1940, when he started to market the invention. Hammes' claim, however, was disputed by General Electric, which introduced a food waste disposer in 1935. Fifty percent of homes in the United States had food waste disposers by 2009.

Continuous feed and batch feed food waste disposers are the prevalent types of food waste disposers in use, today.

Although continuous feed units are more common than batch feed units, batch feed units are considered safer.

Continuous feed units are operated by feeding food waste into the waste disposer after starting the food waste disposer and are more common than batch feed units.

Batch feed food waste disposers are considered safer than continuous feed units, because the top of the batch feed food waste disposer is covered during operation, preventing foreign objects from falling into the unit and preventing children's or adult's hands from getting mangled during the disposal process. Typical batch feed units are operated by placing food waste inside the waste disposer and placing a specially designed cover over the opening, before starting the unit. Some batch feed food waste disposer covers manipulate mechanical switches, while others have magnets in the covers that align with magnets in the units. Slits in the covers allow water to flow through the units.

A batch feed food waste disposer interlock device that is capable of being removably and matingly used with a variety of different food waste disposers having magnetically activated switches, that is capable of activating the magnetically activated switches for turning the food waste disposer on and off, has a removable basket strainer that may be used to discard any collected debris therefrom is necessary.

The batch feed food waste disposer interlock device should be capable of being used as a retrofit in existing installations or in new installations.

The batch feed food waste disposer interlock device should be capable of switching the food waste disposer that the interlock device is removably and matingly removably seated in on and off, as required, acting as a basket strainer, catching and collecting debris, controlling the flow of water, fluid, food waste, or wastewater, by either allowing or preventing the water or food waste from entering and flowing through the interlock device and into the food waste disposer, as directed by a user.

The batch feed food waste disposer interlock device should be capable of turning the food waste disposer on when the food waste disposer interlock device is removably seated in the sink flange of the sink and is in a food waste disposer activation position and turning the food waste disposer off when the food waste disposer interlock device is in the sink flange of the sink and is in a position other than the food waste disposer activation position.

The batch feed food waste disposer interlock device should be capable of being easily and conveniently removed from the food waste disposer to clean and remove any remaining debris therefrom and turning the food waste disposer off, when the food waste interlock device is removed from the sink flange of the sink.

The batch feed food waste disposer interlock device should be durable, light weight, inexpensive, safe to use, attractive, sturdy, of simple construction, and capable of being used in a quick, convenient, and efficient manner.

Different batch feed food waste disposer interlock devices have heretofore been known. However, none of the batch feed food waste disposer interlock devices adequately satisfies these aforementioned needs.

- U.S. Pat. No. 2,012,680 (Hammes) discloses a garbage disposal device, which was adapted to be incorporated between a sink and a drain pipe and which had an electrically driven grinding device for grinding garbage into small particles for passage through the drain pipe with drain water.
- U.S. Pat. No. 7,757,981 (Anderson, et al.) discloses a switching assembly for a food waste disposer that includes a housing, comprising a switch and first and second magnets. An interlock device has third and fourth magnets. The magnets are arranged so that the switch is actuated, when the first and third magnets align and the second and fourth magnets align.
- U.S. Pat. No. 7,500,626 (Berger, et al.) and U.S. Pat. No. 7,503,514 (Berger, et al.) disclose a switching mechanism and a method for a batch feed food waste disposer having a plastic one-piece housing that engages an external surface of the food waste disposer by snapping thereto. The switching mechanism comprises a switch capable of enabling operation of the food waste disposer in response to an interlock device positioned within the drain opening. A method for converting a continuous feed waste disposer into a batch feed waste disposer is also disclosed. The switching mechanism includes a plug having a male end and a female end that can receive the electrical plug from the continuous feed waste disposer.
- U.S. Pat. No. 9,145,666 (Hammer) discloses an apparatus for selectively activating a food waste disposer for a sink that includes a housing and an activation member, which has a magnetically activated switch assembly. The housing includes a switch and a first magnet. The first magnet may be movable relative to the housing and the switch between first and second positions. Movement of the first magnet from the second position to the first position causes corresponding movement of the switch from an off-position, in which electrical current is prevented from reaching a motor of the disposer, to an on-position, which allows electrical current to flow to the motor. The activation member may include a second magnet and is receivable in a tubular member through which waste drains and is positionable relative to the tubular member to place the second magnet in proximity to the first magnet to generate a repulsive magnetic force that moves the first magnet between the first and second positions.

U.S. Pat. No. 8,214,934 (Sullivan) discloses a seamless sink drain assembly with disposer/strainer mounting system. The sink drain assembly comprises a downwardly extending drain sleeve integrally formed on the sink; a resilient, generally cylindrical mounting member formed with an upper annular section adapted to releasably engage the drain sleeve and with a lower annular section adapted to releasably receive an upper portion of a garbage disposer; a clamp removably attachable to the mounting member in overlying relation to the upper and lower annular sections, and a strainer having a radially outwardly extending gasket adapted to establish a generally water tight seal between the strainer and a splashguard mounted on the upper portion of the garbage disposer.

U.S. Pat. No. D537,673 (Anderson, et al.) discloses an ornamental design for a combination interlock and stopper device for a food waste disposer.

U.S. Pat. No. 9,815,064 (Hirsch, et al.) discloses a counter top food waste disposer, which includes a food conveying section, a motor section and a grind and discharge section disposed between the food conveying section and the motor section. In one aspect of the invention, the food waste disposer also includes a discharge area in which a container is removably receivable. When the container is received in the discharge area, during operation of the food waste disposer food, waste is dischargeable from a discharge outlet of a discharge section into the container. In another aspect of the invention, a hose is removably receivable in the discharge area when the container is not present and food waste is discharged through the hose when it is received in the discharge area. In yet another aspect of the invention, the food waste disposer includes a water reservoir from which water can be introduced into the food waste disposer.

U.S. Patent Application Publication No. 2004/0178289 (Jara-Almonte; et al.) discloses an interlock device for a batch feed waste disposer, which includes: means for activating a switch on an interlock protected food waste disposer without blocking the drain opening; and means for blocking the drain opening without activating an interlock protected food waste disposer.

U.S. Patent Application Publication No. 2006/0038047 (Anderson, et al.) discloses a combination interlock and stopper device for a batch feed food waste disposer that includes a first end receivable in a drain opening to plug the drain opening with a first handle attached thereto. Stopping members are attached to the first end that have at least a portion thereof extending beyond the outer periphery of the first end for engaging a ledge of the drain opening. The device further includes a second end opposite the first end, with a magnet attached to the second end to selectively actuate the food waste disposer, when the second end is inserted into the drain opening. A second handle is attached to the second end.

Chinese Patent No. CN204257505 (Wang Zhengling) discloses a magnetic switch assembly for a food waste processor, comprising a shell and an interlocking device, which is arranged at the water inlet of the food waste processor. An edge of the interlocking device is provided with a first magnet, which can be driven to rotate leftwards or rightwards. The shell surrounds the interlocking device, and a starting switch and a second magnet control device are arranged in the shell. The second magnet control device comprises a lever arm and a second magnet. The magnetic switch assembly is arranged to enable the starting switch to be started when the first magnet and the second magnet are aligned and interact to enable the second magnet to generate displacement to drive the lever arm.

Different strainers and drain devices have heretofore been known. However, none of the strainers and drain devices adequately satisfies these aforementioned needs.

U.S. Pat. No. 5,535,455 (Liu) discloses a sink strainer for a garbage disposal unit that includes a strainer unit, a seat and a mounting flange. The strainer unit includes a handle, a strainer member and a plug member. The plug member has a platform and a surrounding wall depending from the platform on which multiple slope guide are located. The seat includes a limiter located at a lower portion of the seat, a stopping surface protruding from and surrounding a middle portion of the seat, a snapping portion at a top of the seat, and another snapping portion at a bottom of the seat. The mounting flange is provided at a top end with a flange portion and at a bottom end with a mounting portion. The sink strainer may further include a decorative flange having a flange portion and a snapping portion, which are dimensioned and configured to abut on, and be engaged with, the flange portion and top snapping portion of the seat.

U.S. Pat. No. 6,145,136 (Parisi, et al.) discloses a strainer for a drain assembly that has a cup-shaped body having an outer peripheral wall with slots for draining water, an upraised central portion having an inner peripheral wall with slots for draining water, and a floor extending between the two walls with openings for draining water. A bail is pivotally secured to the upright central portion for manipulating the strainer. The strainer also has a plurality of tabs, which extend outwardly from the body to interfit with a retainer within a sink for securement purposes.

U.S. Pat. No. 3,596,294 (Hoffman) discloses a basket strainer or sink-drain device, which includes a stop valve therefor. The basket strainer has a plurality of elongated apertures having integral baffle plates adapted to deflect the flow of waste water from the perimeter of the strainer toward the center thereof and an improved stop valve having a cuplike catch basin, which has a disk screen retainer thereon for entrapping solid waste articles.

U.S. Pat. No. 4,320,540 (Leavens) discloses a discharge drain assembly for use in a sink that includes a drain body and a plug assembly adapted to fit in the drain body, which features limited rotational movement between an open and a closed position. The plug includes a stainless steel strainer with an integral hollow knob having opposed sides, which are inwardly concave. The knob securely but releasably retains a slotted head portion of a spindle. The spindle has a neck portion for receiving a sealing washer and a lower body portion, including three leg portions. The leg portions support the plug in the open position, restrain rotation in a first direction beyond the open position, and cam the plug to the closed position when rotated in a direction opposite the first direction. The structure substantially eliminates a "finding" problem common in prior art arrangements and provides a seal in the closed position.

U.S. Pat. No. 6,108,828 (Cheng) discloses a drain cover assembly for a sink, which includes a generally cylindrical basket having a flat bottom. A sealing plate is attached to the underside of the flat bottom. A plurality of apertures sized to permit the drainage of liquids from the sink, but prevent solid materials from passing therethrough, are located on the bottom of the basket about the sealing plate. An externally threaded member extends from the bottom of the sealing plate. The plug may be cylindrically shaped or frustoconically shaped and is press fit into a drainpipe. The plug has an open upper end and a bottom surface. The bottom surface contains a plurality of apertures to allow for liquid to drain but to prevent solid materials from passing therethrough. The bottom surface of the plug has an internally threaded member extending upwardly therefrom, which mates with the threaded member extending from the bottom of the sealing plate. The upper edge of the plug contacts the sealing plate to seal the drain cover assembly, when the basket is threaded down on the plug. The assembly is opened by rotating the basket with respect to the plug from a space between the sealing plate and the plug to allow liquid to drain therethrough.

For the foregoing reasons, there is thus a need for a batch feed food waste disposer interlock device that is capable of being removably and matingly used with a variety of different food waste disposers having magnetically activated switches, that is capable of activating the magnetically activated switches for turning the food waste disposer on and off, has a removable basket strainer that may be used to discard any collected debris therefrom is necessary.

The batch feed food waste disposer interlock device should be capable of being used as a retrofit in existing installations or in new installations.

The batch feed food waste disposer interlock device should be capable of switching the food waste disposer that the interlock device is removably and matingly removably seated in on and off, as required, acting as a basket strainer, catching and collecting debris, controlling the flow of water or food waste, by either allowing or preventing the water or food waste from entering and flowing through the interlock device and into the food waste disposer, as directed by a user.

The batch feed food waste disposer interlock device should be capable of turning the food waste disposer on when the food waste disposer interlock device is removably seated in the sink flange of the sink and is in a food waste disposer activation position and turning the food waste disposer off when the food waste disposer interlock device is in the sink flange of the sink and is in a position other than the food waste disposer activation position.

The batch feed food waste disposer interlock device should be capable of being easily and conveniently removed from the food waste disposer to clean and remove any remaining debris therefrom and turning the food waste disposer off, when the food waste interlock device is removed from the sink flange of the sink.

The batch feed food waste disposer interlock device should be durable, light weight, inexpensive, safe to use, attractive, sturdy, of simple construction, and capable of being used in a quick, convenient, and efficient manner.

SUMMARY

The present invention is directed to a batch feed food waste disposer interlock device that is capable of being removably and matingly used with a variety of different food waste disposers having magnetically activated switches, that is capable of activating the magnetically activated switches for turning the food waste disposer on and off, and has a removable basket strainer that may be used to discard any collected debris therefrom.

The batch feed food waste disposer interlock device is capable of being used as a retrofit in existing installations or in new installations.

The batch feed food waste disposer interlock device is capable of switching the food waste disposer that the interlock device is removably and matingly removably seated in on and off, as required, acting as a basket strainer, catching and collecting debris, controlling the flow of water, fluid, food waste, or wastewater by either allowing or preventing the water, fluid, food waste, or wastewater from entering and flowing through the interlock device and into the food waste disposer, as directed by a user.

The batch feed food waste disposer interlock device is capable of turning the food waste disposer on when the food waste disposer interlock device is removably seated in the sink flange of the sink and is in a food waste disposer activation position and turning the food waste disposer off when the food waste disposer interlock device is seated in the sink flange of the sink and is in a position other than the food waste disposer activation position.

The batch feed food waste disposer interlock device is capable of being easily and conveniently removed from the food waste disposer to clean and remove any remaining debris therefrom and turning the food waste disposer off, when the food waste interlock device is removed from the sink flange of the sink.

The batch feed food waste disposer interlock device is durable, light weight, inexpensive, safe to use, attractive, sturdy, of simple construction, and capable of being used in a quick, convenient, and efficient manner.

An interlock device, which is coupled to a magnetically activated switch when the interlock device is removably seated in a sink flange coupled to a food waste disposer, in which the magnetically activated switch is coupled to the food waste disposer and has a switch magnet, having features of the present invention, comprises: a substantially disk shaped base having: a substantially cylindrical collar, opposing interlock device magnets adjacent the periphery of the substantially cylindrical collar, a substantially centrally disposed recessed seat having a plurality of recessed seat drain holes, a substantially centrally disposed tubular helical cam, which is adjoined to the substantially disk shaped base, having: opposing longitudinal helical grooves, a substantially centrally disposed bore extending through the substantially centrally disposed tubular helical cam and the substantially centrally disposed recessed seat, a strainer basket having: a plurality of strainer basket drain holes, a substantially centrally disposed spindle rotatably mounted through the substantially centrally disposed bore, the substantially centrally disposed spindle adjoined to the strainer basket and having a handle adjoined thereto, the substantially centrally disposed spindle having opposing nubs, which travel within the opposing longitudinal helical grooves, when the handle is rotatably twisted, a substantially disk shaped spindle mounted seal adapted to block flow of any fluid, waste, or wastewater through the interlock device, when: the substantially disk shaped spindle mounted seal is releasably seated in the substantially centrally disposed recessed seat, the substantially disk shaped spindle mounted seal allowing the fluid, waste, or wastewater to flow through the interlock device, when: the substantially disk shaped spindle mounted seal is releasably unseated from the substantially centrally disposed recessed seat; the interlock device activating the food waste disposer when the interlock device is removably seated in the sink flange and one of the opposing interlock device magnets is adjacent the switch magnet.

An alternate embodiment of an interlock device, which is coupled to a magnetically activated switch when the interlock device is removably seated in a sink flange coupled to a food waste disposer, in which the magnetically activated switch is coupled to the food waste disposer and has a switch magnet, having features of the present invention, comprises: a substantially disk shaped base having: a substantially cylindrical collar, at least one interlock device magnet adjacent the periphery of the substantially cylindrical collar, a substantially centrally disposed recessed seat having a plurality of recessed seat drain holes, a substantially centrally disposed tubular helical cam, which is adjoined to the substantially disk shaped base, having: at least one longitudinal helical groove, a substantially centrally disposed bore extending through the substantially centrally disposed tubular helical cam and the substantially centrally disposed recessed seat, a strainer basket having: a plurality of strainer basket drain holes, a substantially centrally disposed spindle rotatably mounted through the substantially centrally disposed bore, the substantially centrally disposed spindle adjoined to the strainer basket and having a handle adjoined thereto, the substantially centrally disposed spindle having at least one nub, which travels within the at least one longitudinal helical groove, when the handle is rotatably twisted, a substantially disk shaped spindle mounted seal adapted to block flow of any fluid, waste, or wastewater through the interlock device, when: the substantially disk shaped spindle mounted seal is releasably seated in the substantially centrally disposed recessed seat, the substantially disk shaped spindle mounted seal allowing the fluid, waste, or wastewater to flow through the interlock device, when: the substantially disk shaped spindle mounted seal is releasably unseated from the substantially centrally disposed recessed seat; the interlock device activating the food waste disposer when the interlock device is removably seated in the sink flange and the at least one interlock device magnet is adjacent the switch magnet.

An interlock assembly having features of the present invention comprises an interlock device and a magnetically activated switch, the interlock device coupled to the magnetically activated switch when the interlock device is removably seated in a sink flange coupled to a food waste disposer, the magnetically activated switch coupled to the food waste disposer, comprises:

the interlock device, which has a substantially disk shaped base having: a substantially cylindrical collar, at least one interlock device magnet adjacent the periphery of the substantially cylindrical collar, a substantially centrally disposed recessed seat having a plurality of recessed seat drain holes, a substantially centrally disposed tubular helical cam, which is adjoined to the substantially disk shaped base, having: at least one longitudinal helical groove, a substantially centrally disposed bore extending through the substantially centrally disposed tubular helical cam and the substantially centrally disposed recessed seat, a strainer basket having: a plurality of strainer basket drain holes, a substantially centrally disposed spindle rotatably mounted through the substantially centrally disposed bore, the substantially centrally disposed spindle adjoined to the strainer basket and having a handle adjoined thereto, the substantially centrally disposed spindle having at least one nub, which travels within the at least one longitudinal helical groove, when the handle is rotatably twisted, a substantially disk shaped spindle mounted seal adapted to block flow of any fluid, waste, or wastewater through the interlock device, when: the substantially disk shaped spindle mounted seal is releasably seated in the substantially centrally disposed recessed seat, the substantially disk shaped spindle mounted seal allowing the fluid, waste, or wastewater to flow through the interlock device, when: the substantially disk shaped spindle mounted seal is releasably unseated from the substantially centrally disposed recessed seat; the magnetically activated switch, which has a switch magnet: the magnetically activated switch activating the food waste disposer when the interlock device is removably seated in the sink flange and the at least one interlock device magnet is adjacent the switch magnet, the magnetically activated switch deactivating the food waste disposer when the interlock device is removably seated in the sink flange and the at least one interlock device magnet is in a position other than adjacent to the switch magnet, the magnetically activated switch deactivating the food waste disposer when the interlock device is unseated from the sink flange.

DRAWINGS

These and other features, aspects, and advantages of the present invention will become better understood with regard to the following description, appended claims, and accompanying drawings where:

FIG. 1 is an exploded perspective view of components of an interlock assembly, comprising an interlock device, a magnetically activated switch, and an electric circuit box, constructed in accordance with the present invention, showing a food waste disposer, a flange mounted within a food waste disposer sink mount, and a cutaway view of a sink that the food waste disposer may be mounted to;

Figure 1:
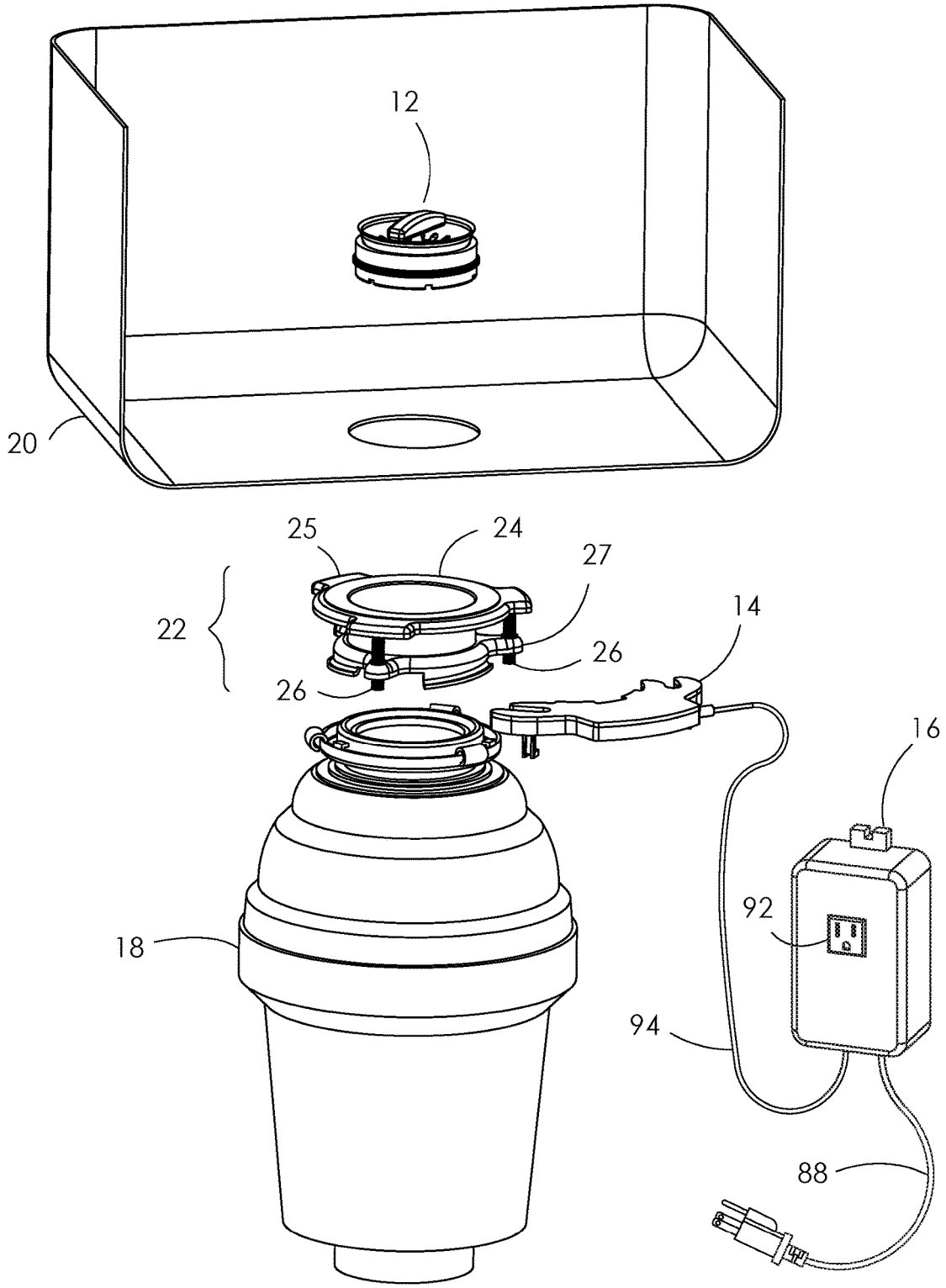
Figure 2:
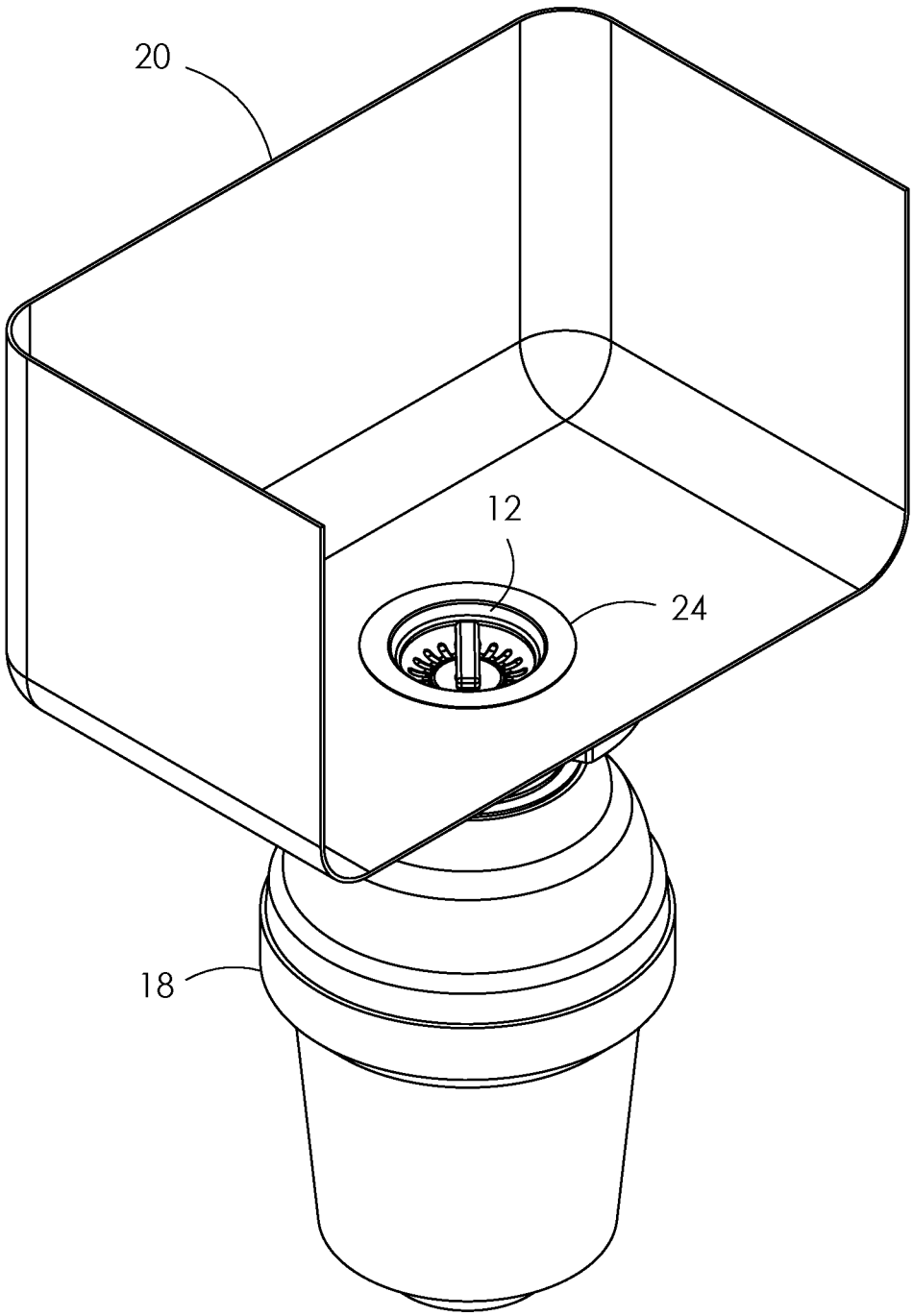
FIG. 2 is a top perspective view of the interlock device and the magnetically activated switch of the interlock assembly of FIG. 1, showing the interlock device seated in the flange and showing the sink as a cutaway view.
Figure 3:
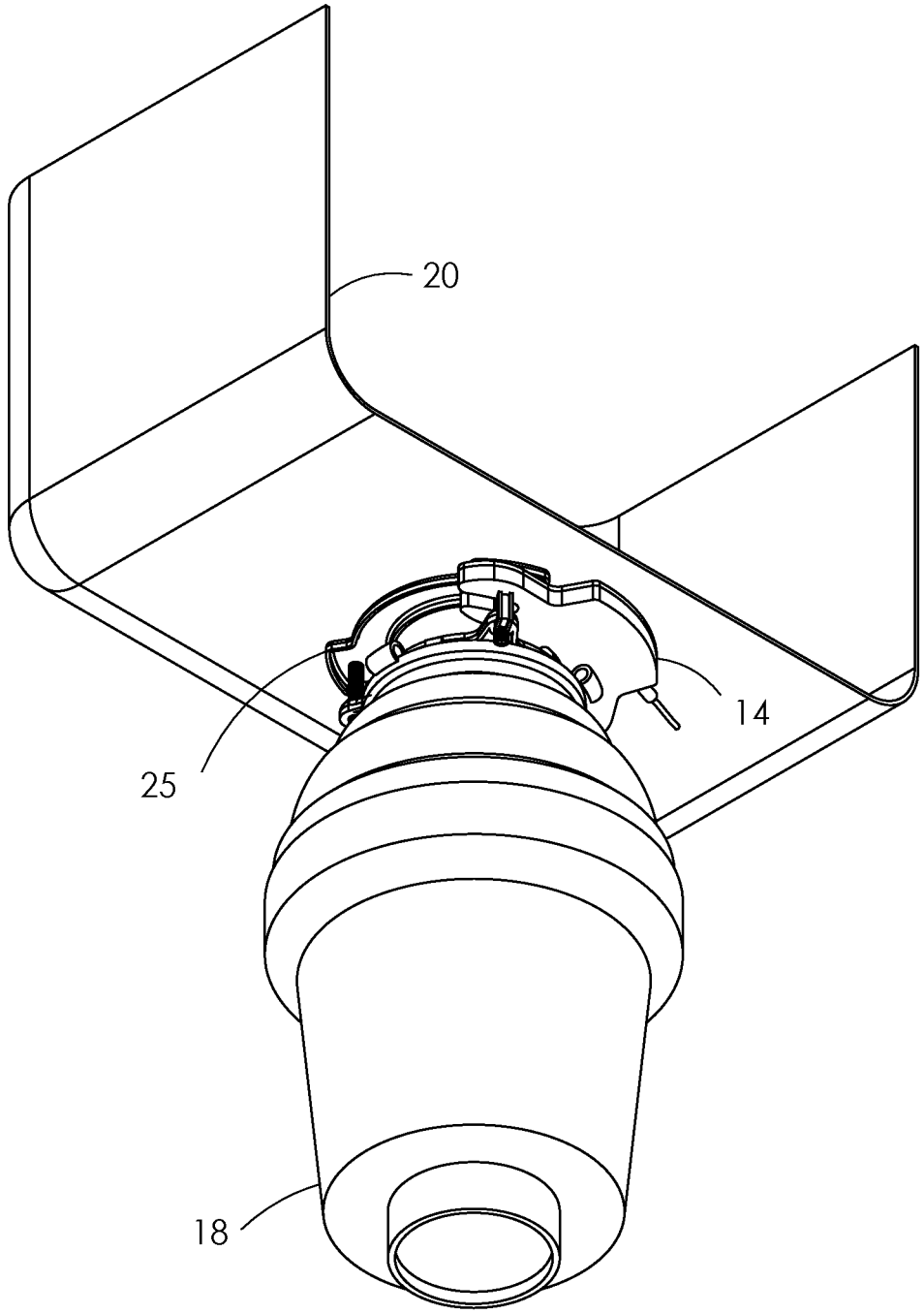
FIG. 3 is a bottom perspective view of the food waste disposer of FIG. 1, showing the magnetically activated switch fastened to the food waste disposer sink mount and showing the sink as a cutaway view.
Figure 4:
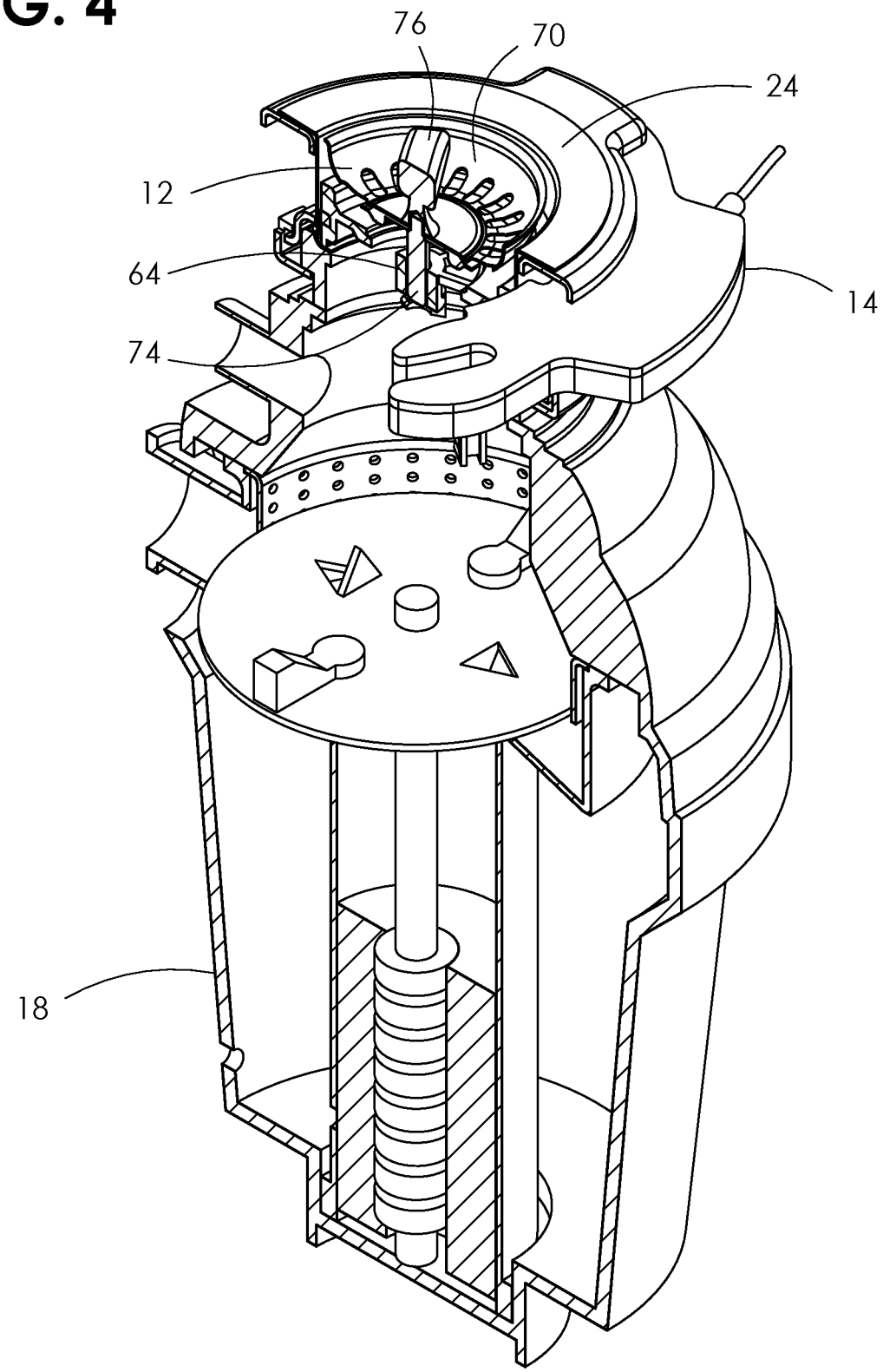
FIG. 4 is a perspective combined partial section and cutaway view of the food waste disposer of FIG. 1, showing the magnetically activated switch fastened to the food waste disposer sink mount and the interlock device seated in the flange.
Figure 5:
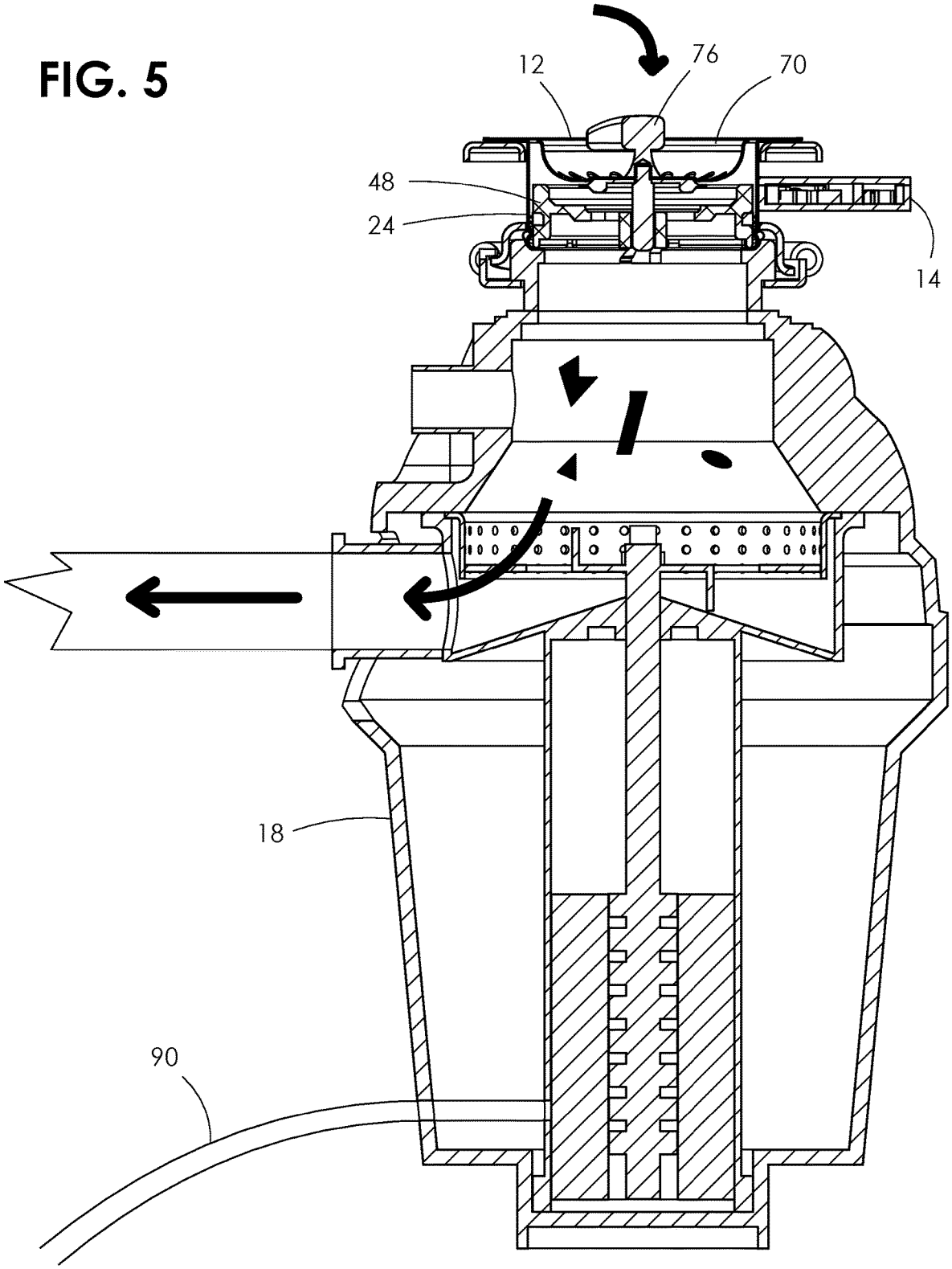
FIG. 5 is a side cross section view of the food waste disposer of FIG. 1, showing the magnetically activated switch fastened to the food waste disposer sink mount and the interlock device seated in the flange.
Figure 6:
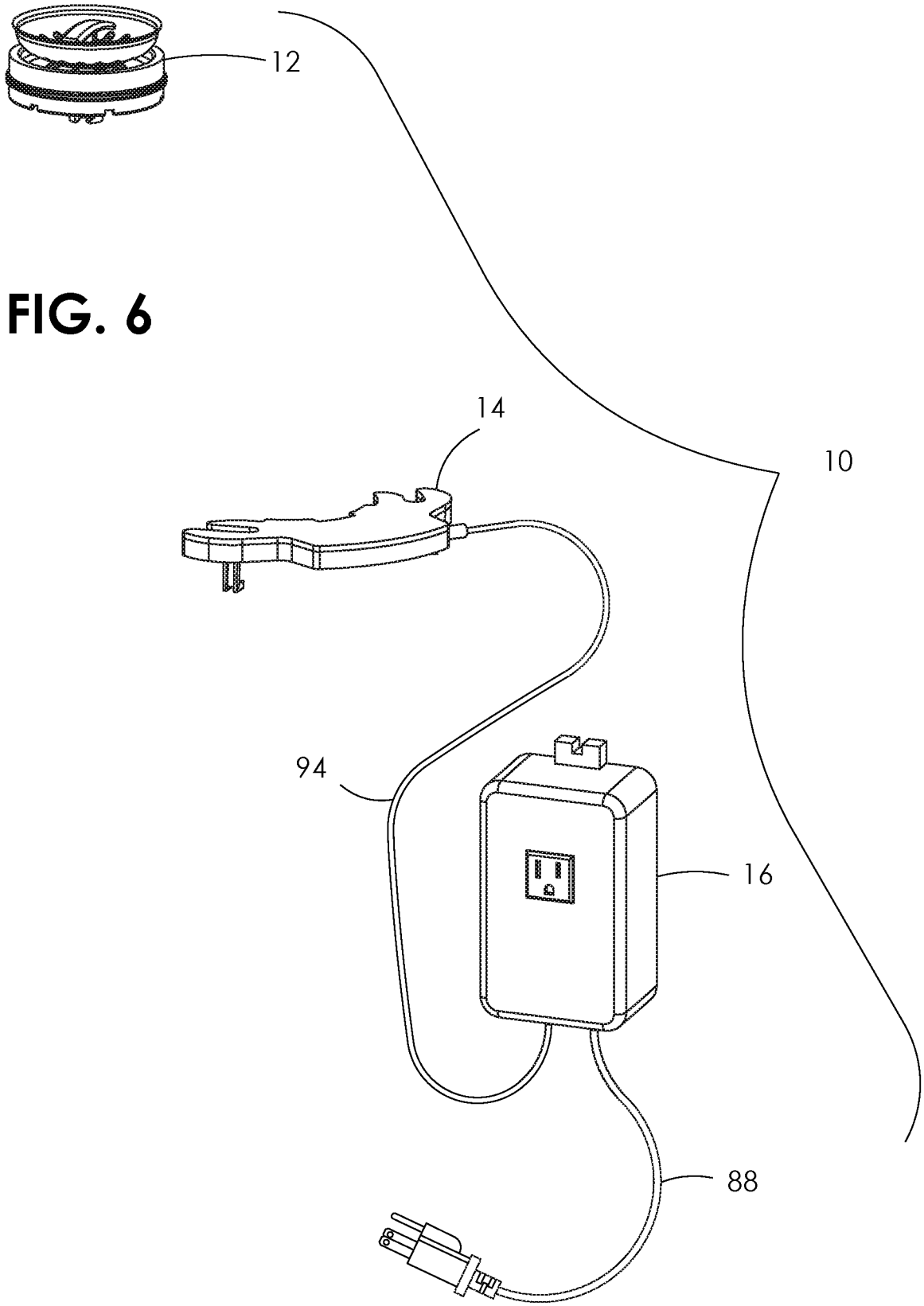
Figure 7:
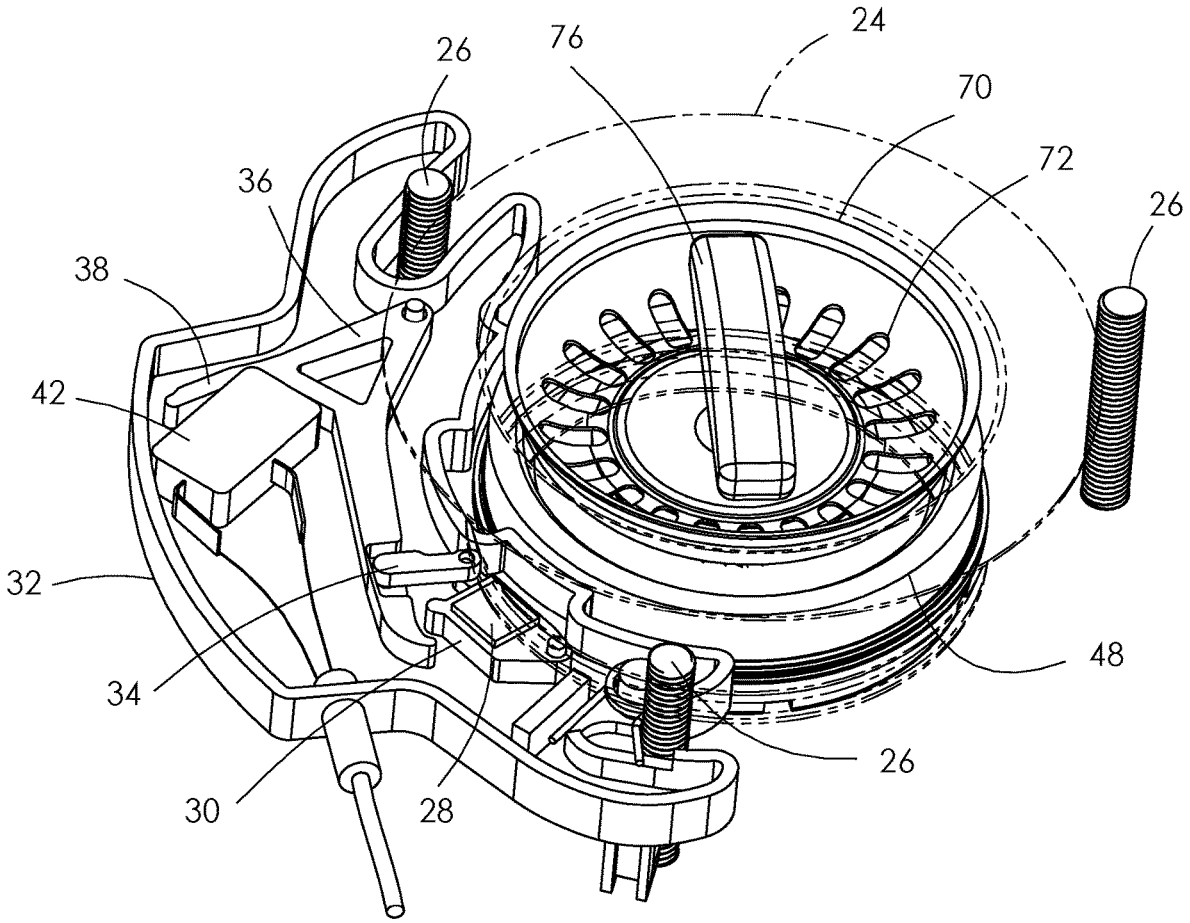
Figure 8:
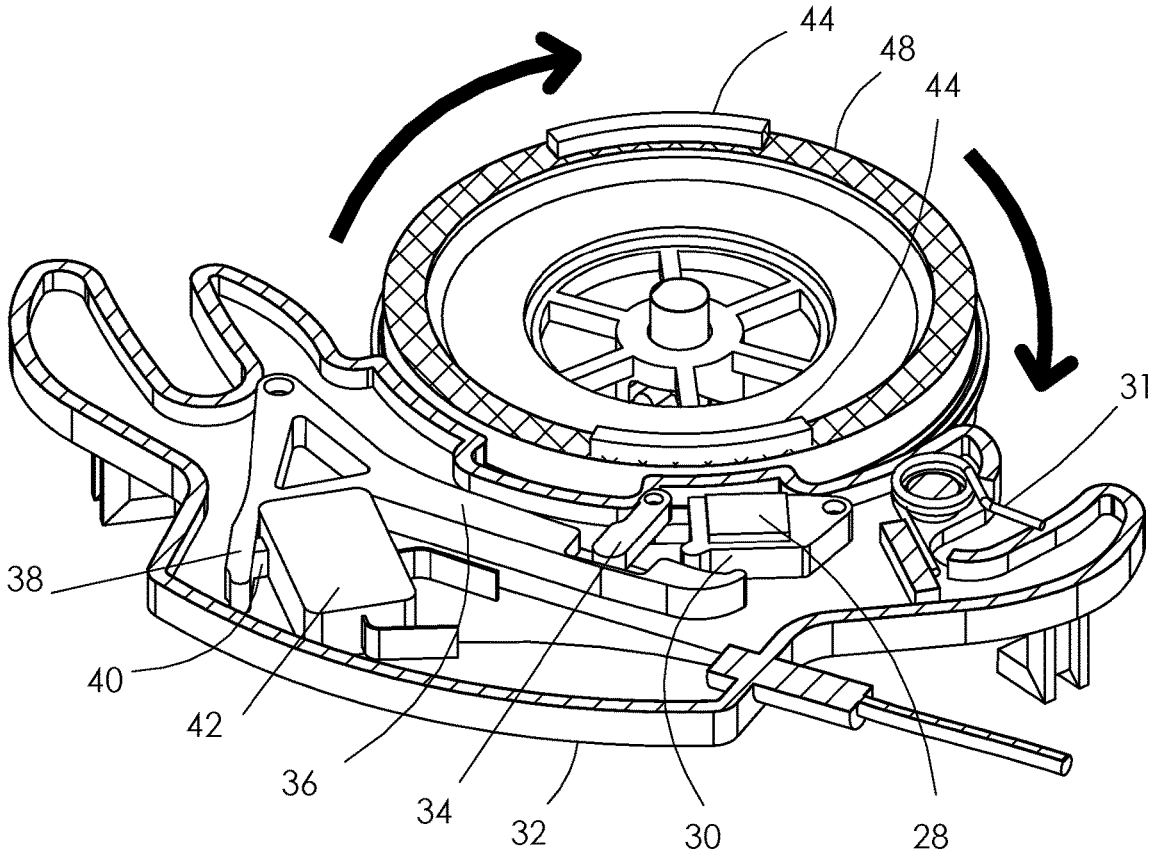
Figure 9:
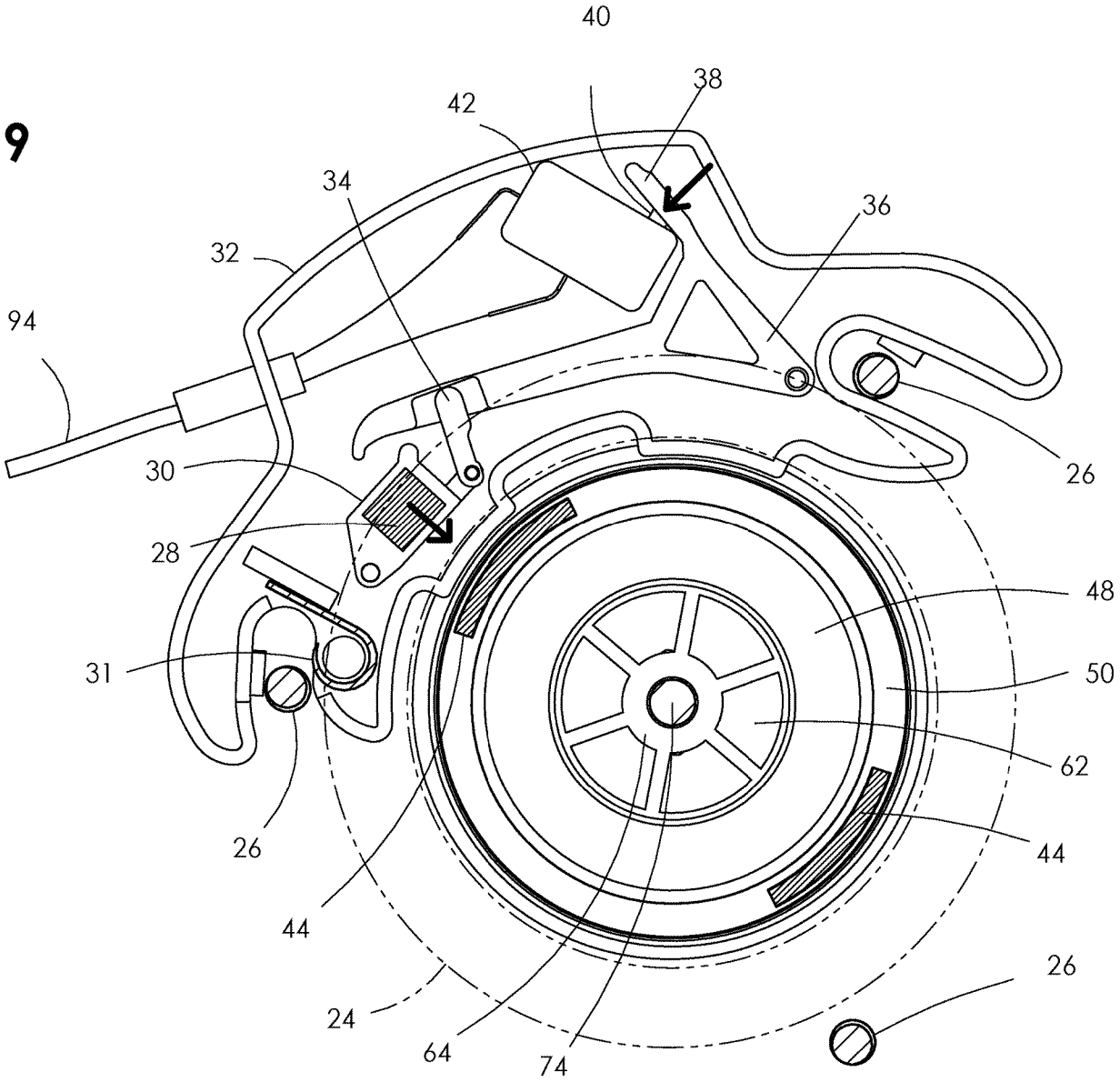
Figure 10:
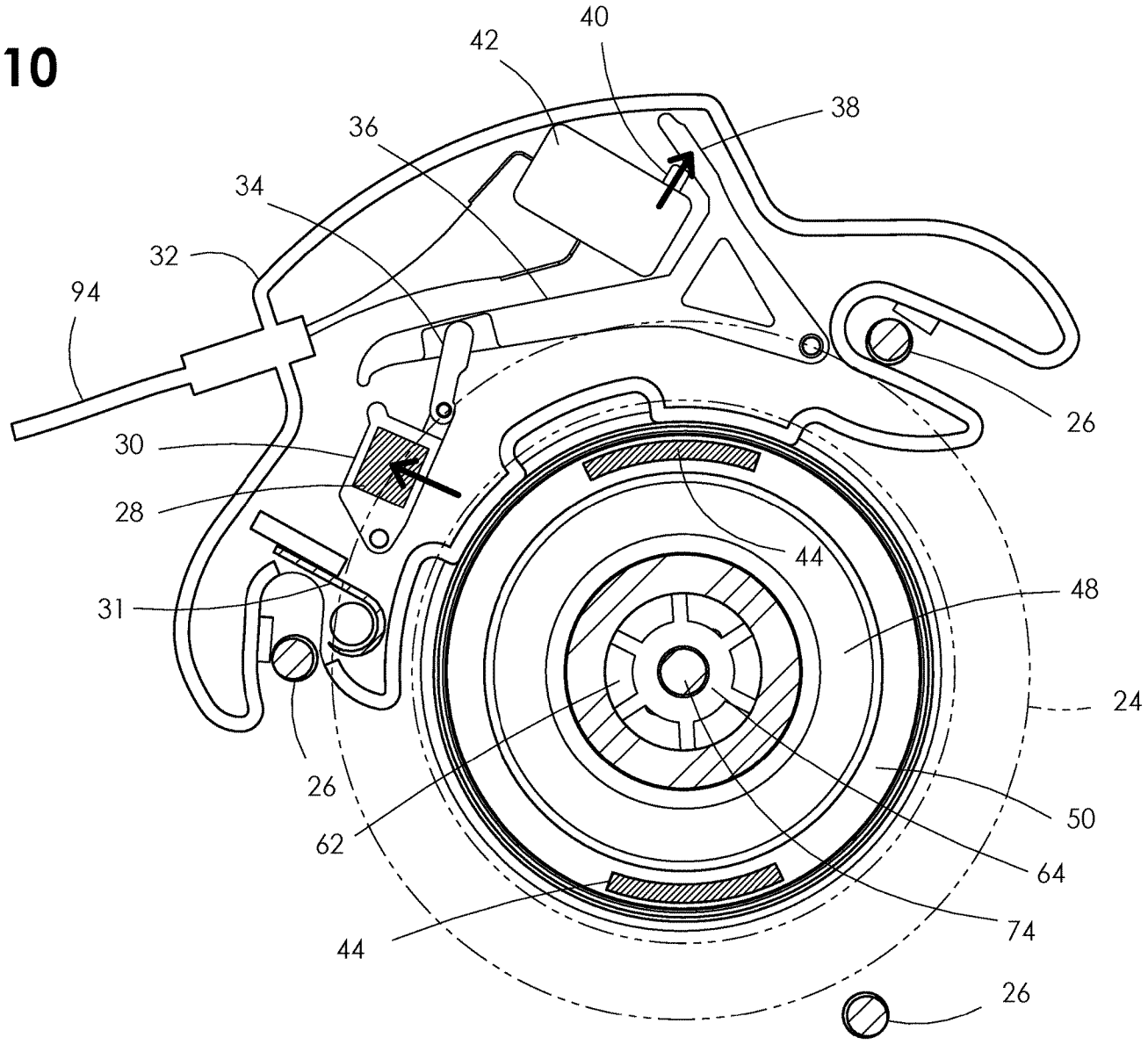
Figure 11:
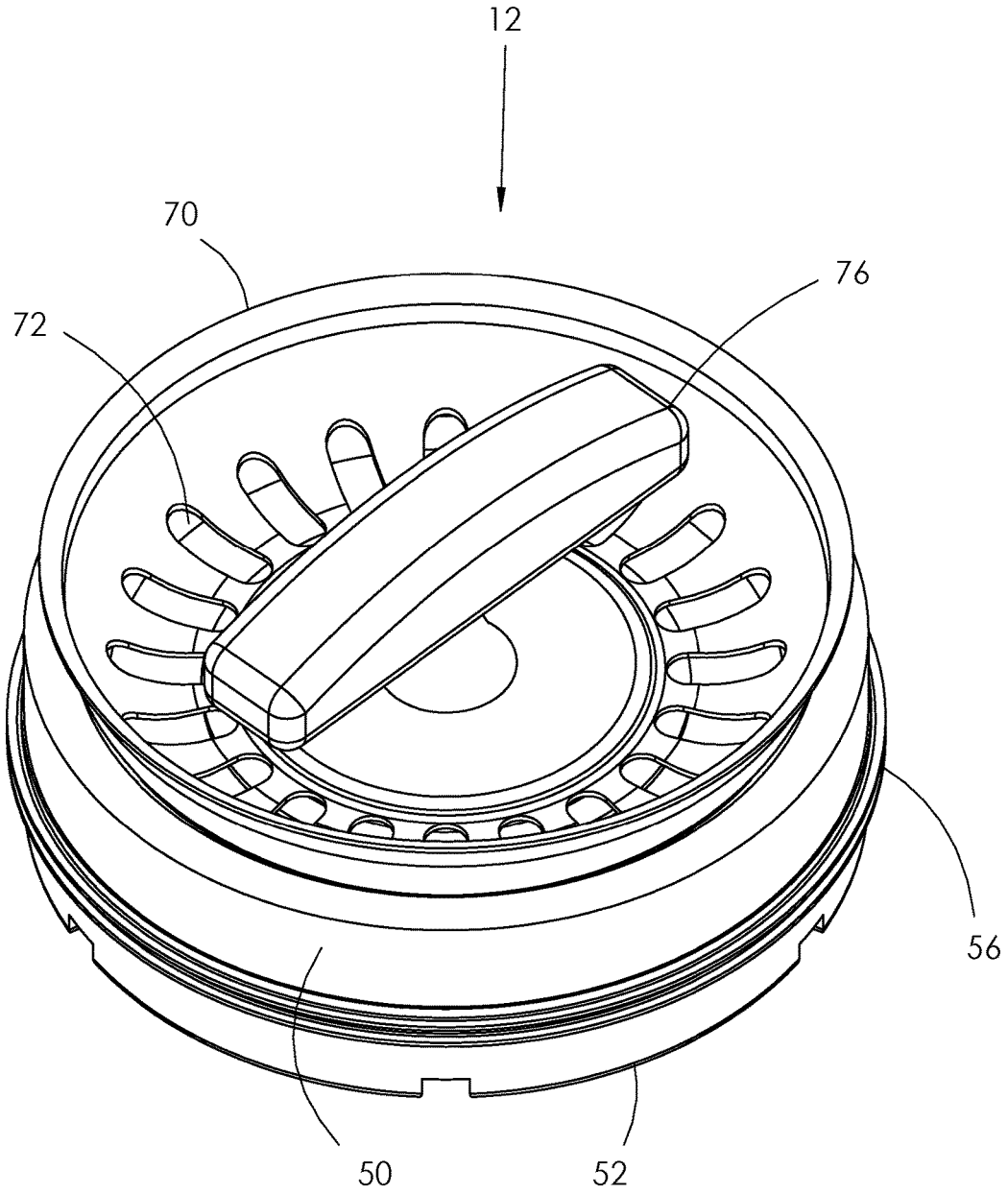
Figure 12:
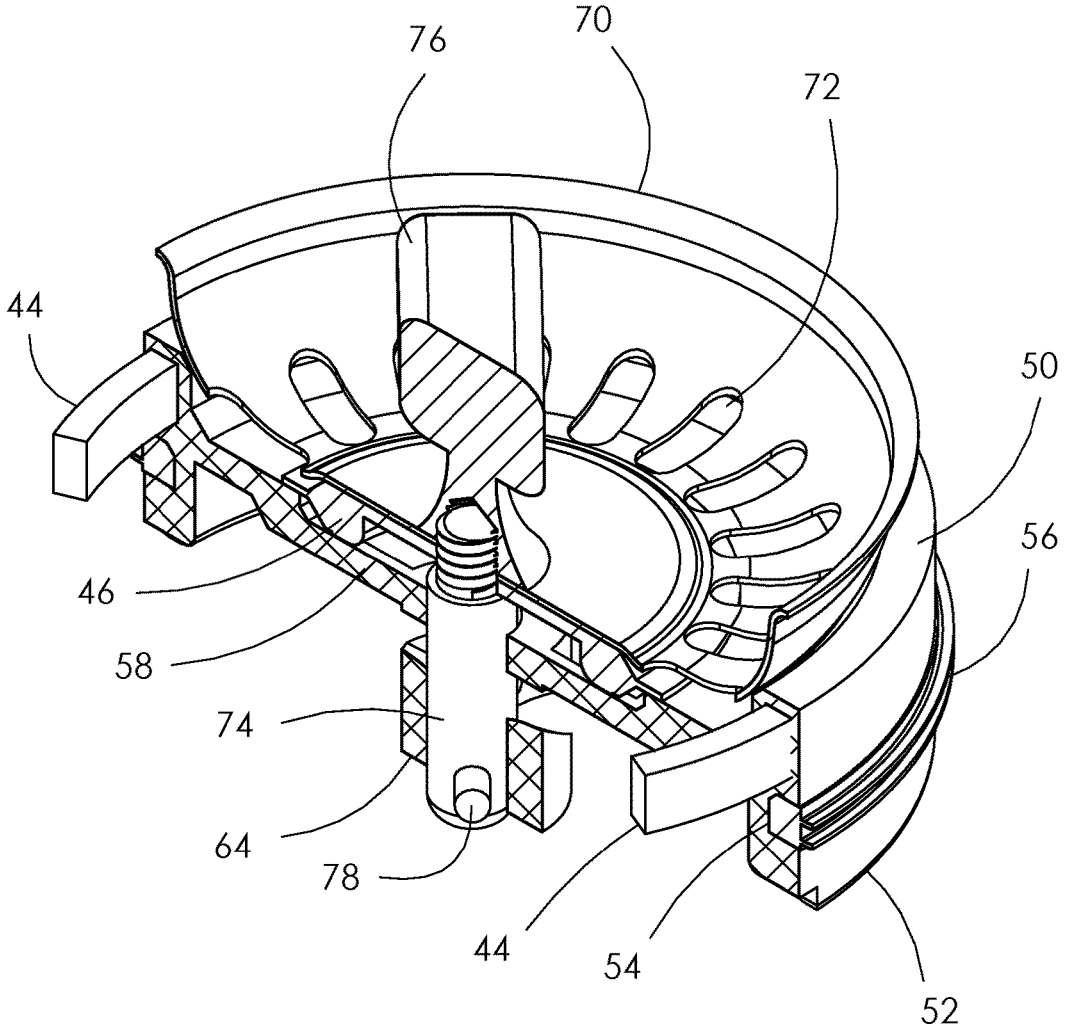
Figure 13:
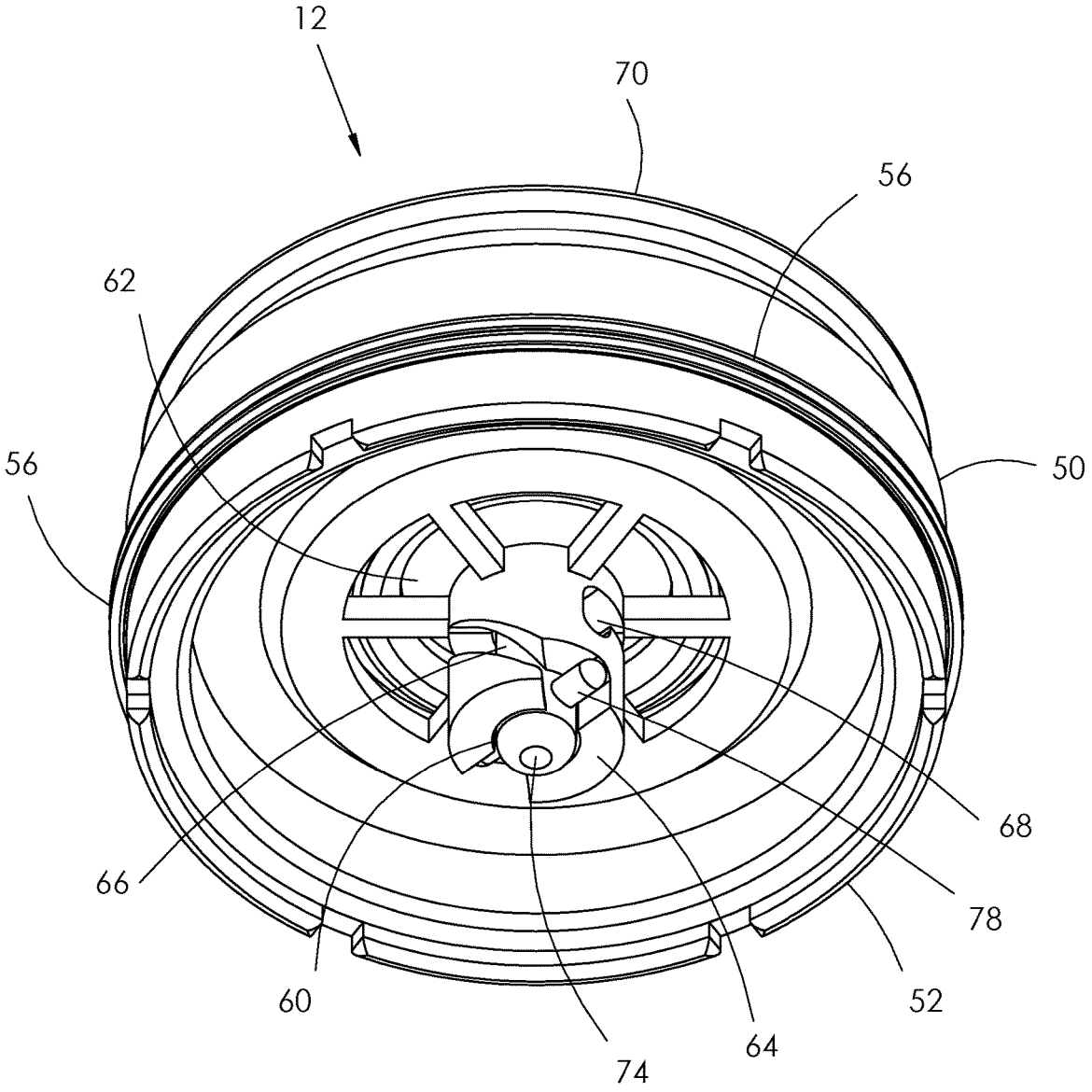
Figure 14:
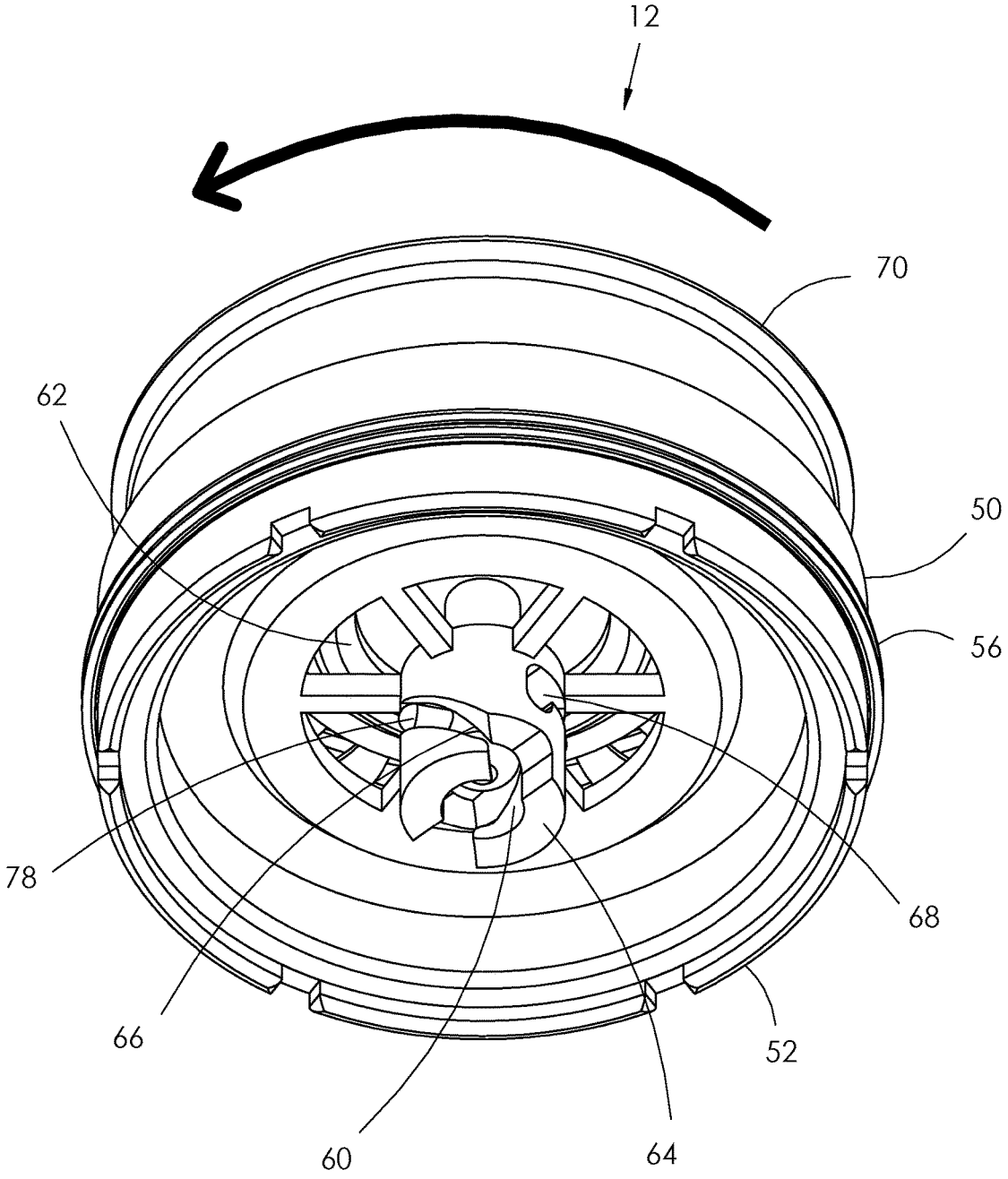
Figure 15:
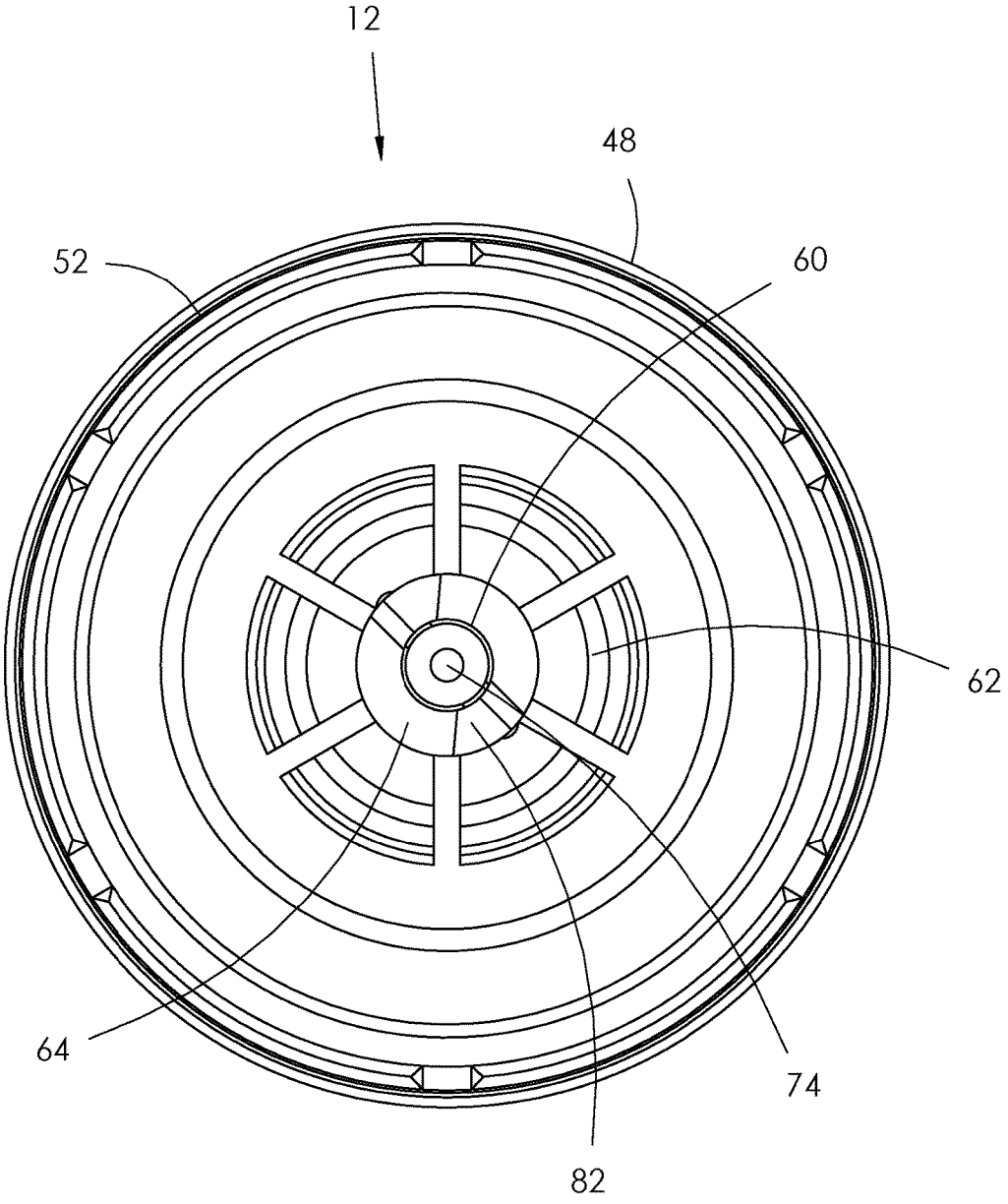
Figure 16:
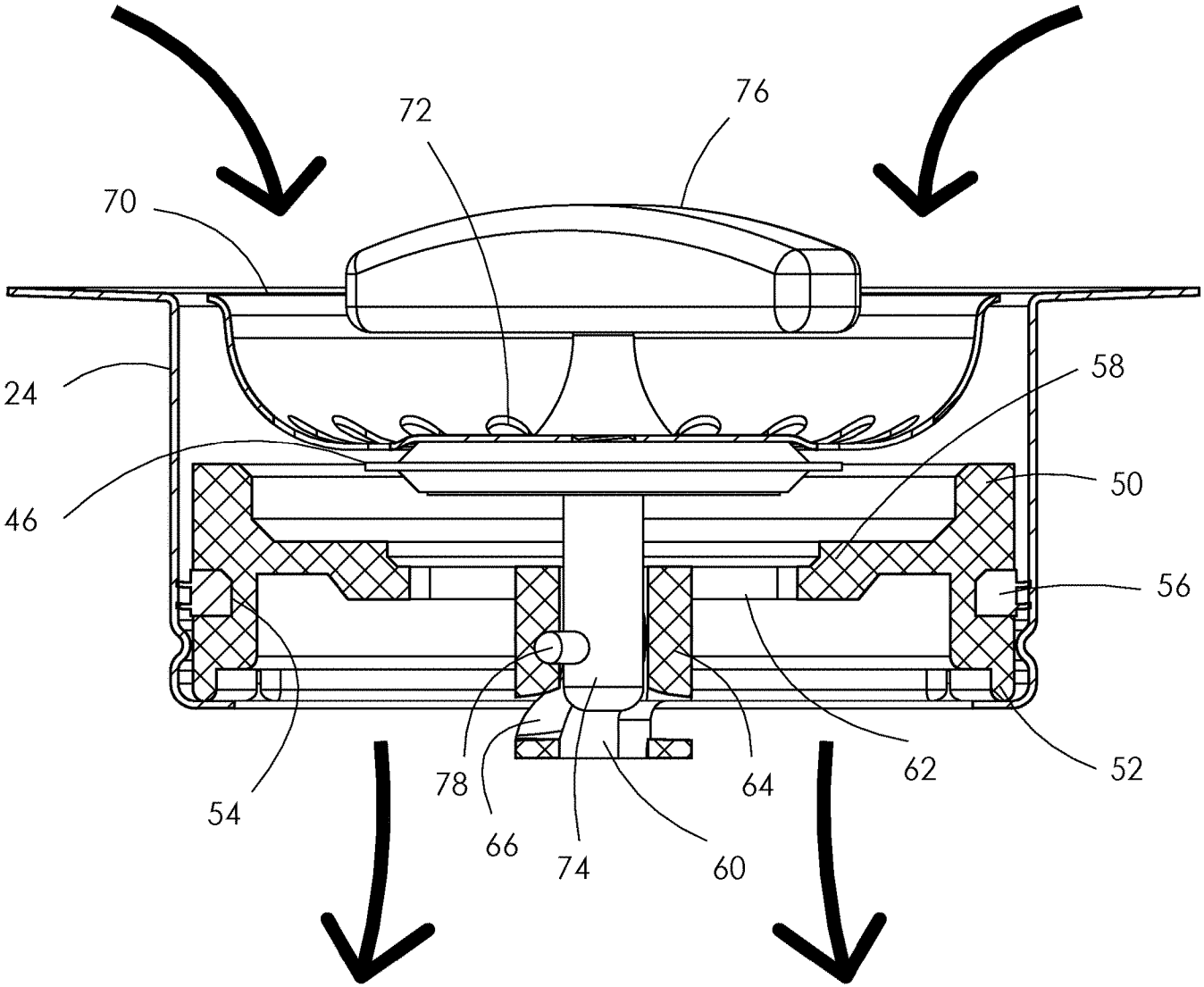
Figure 17:
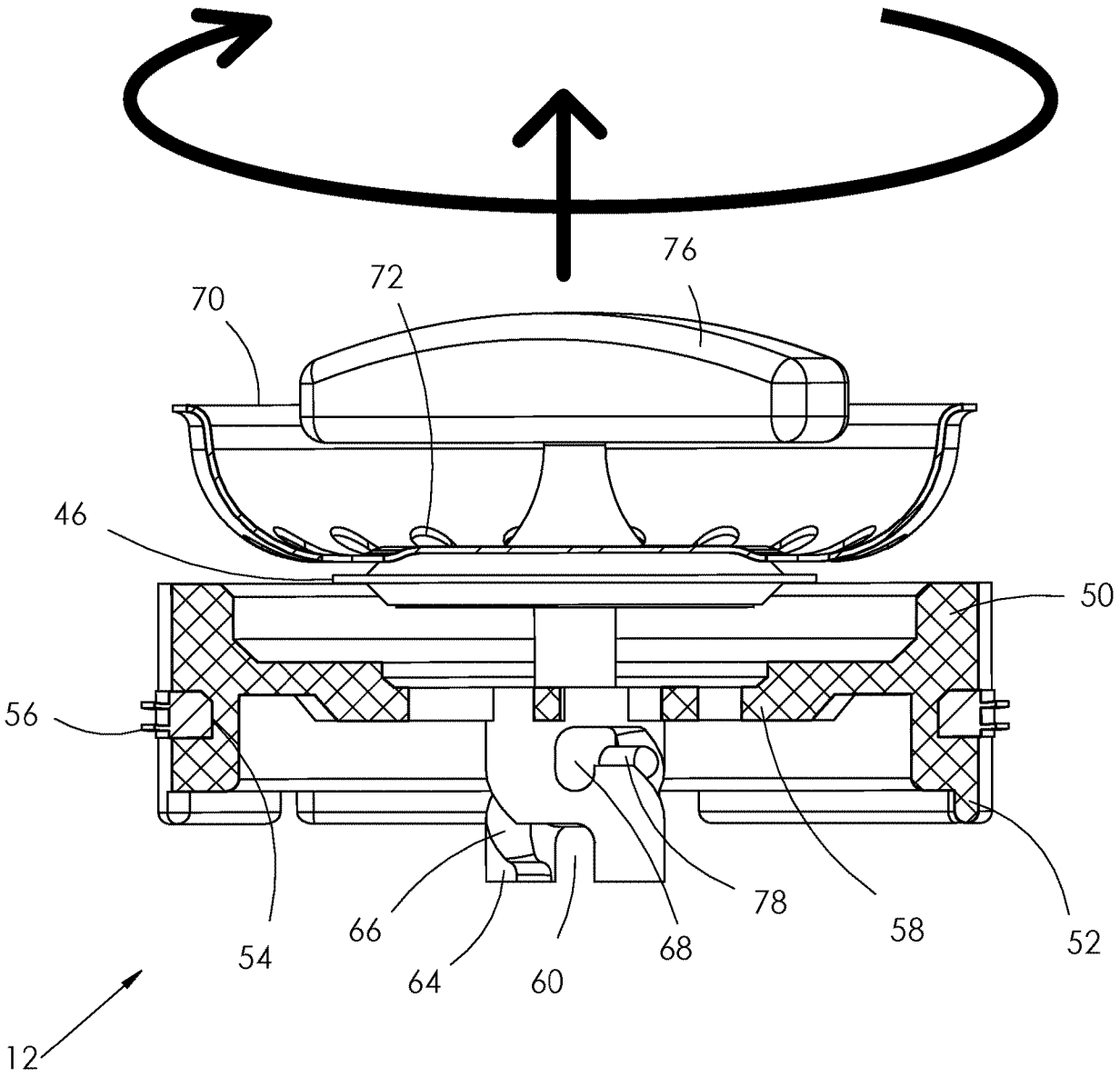
Figure 18:
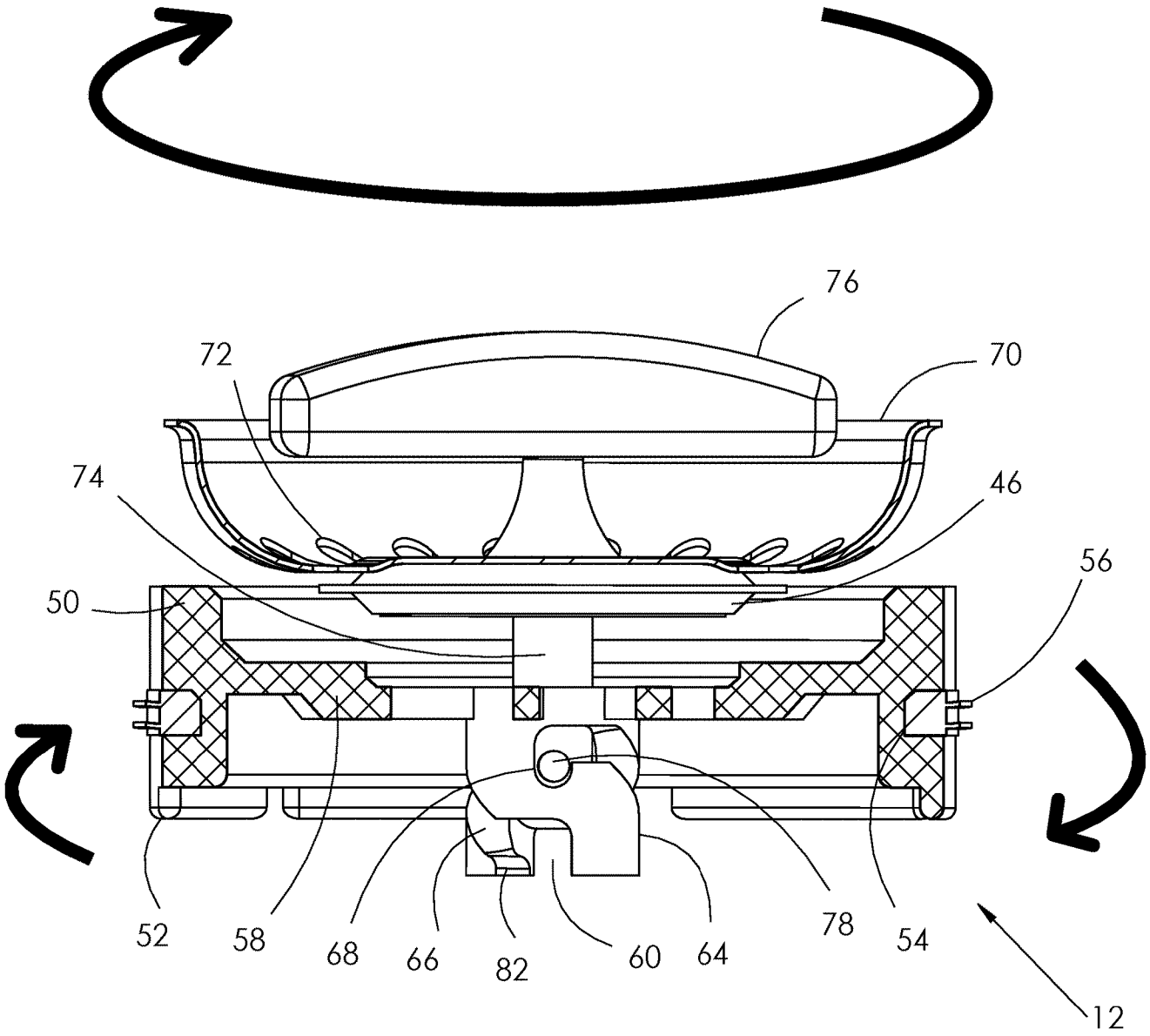
Figure 19:
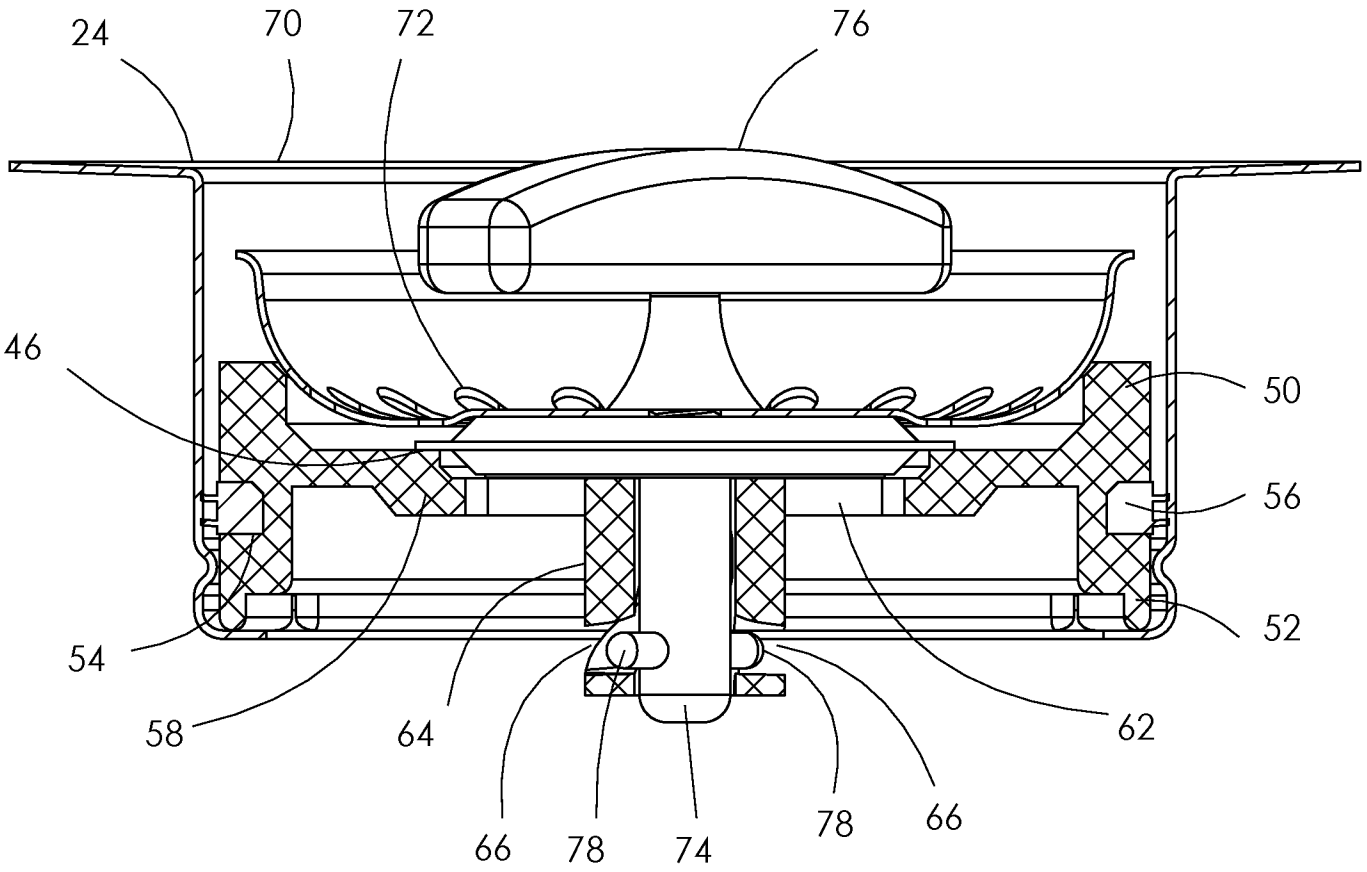
Figure 20:
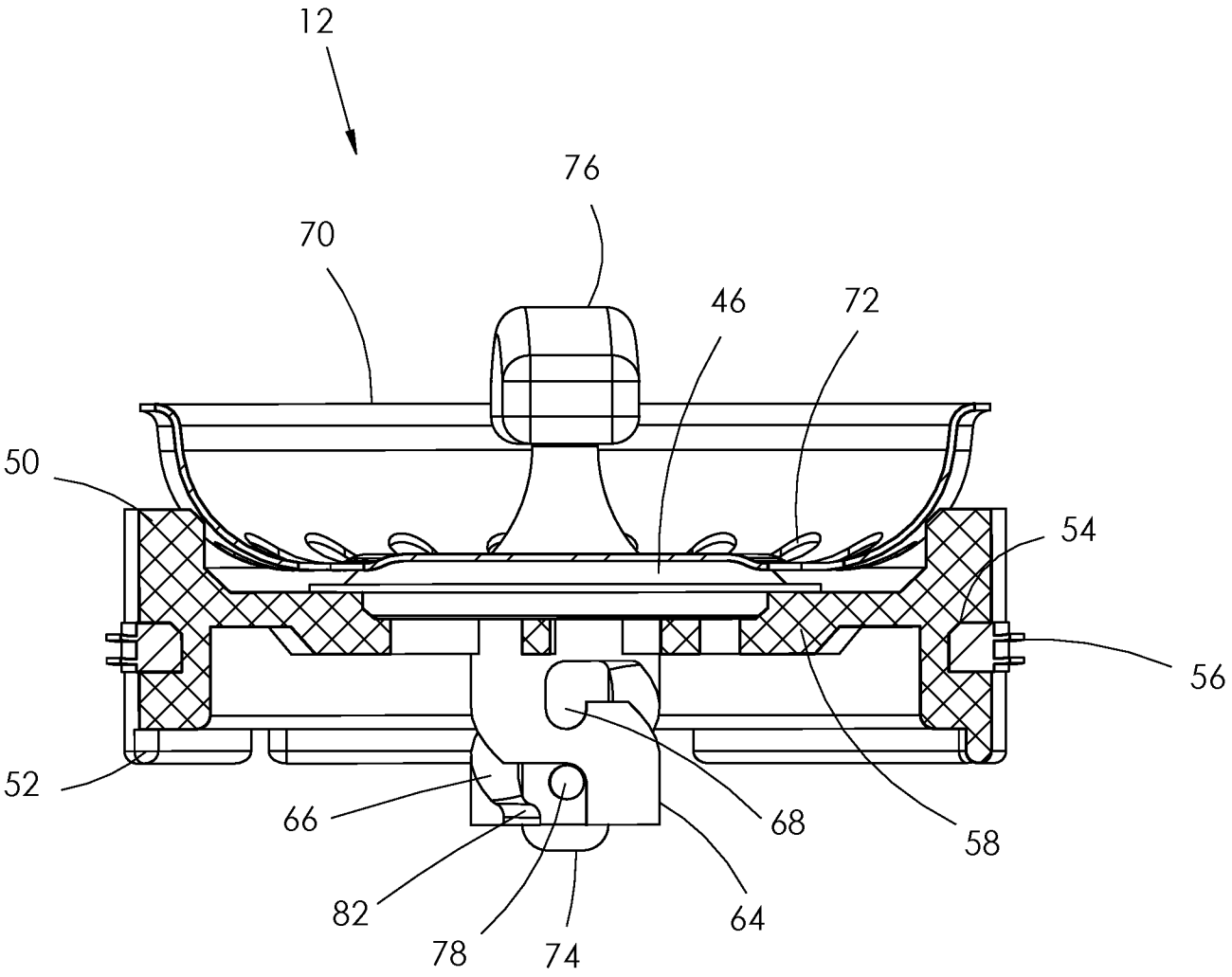
Figure 21:
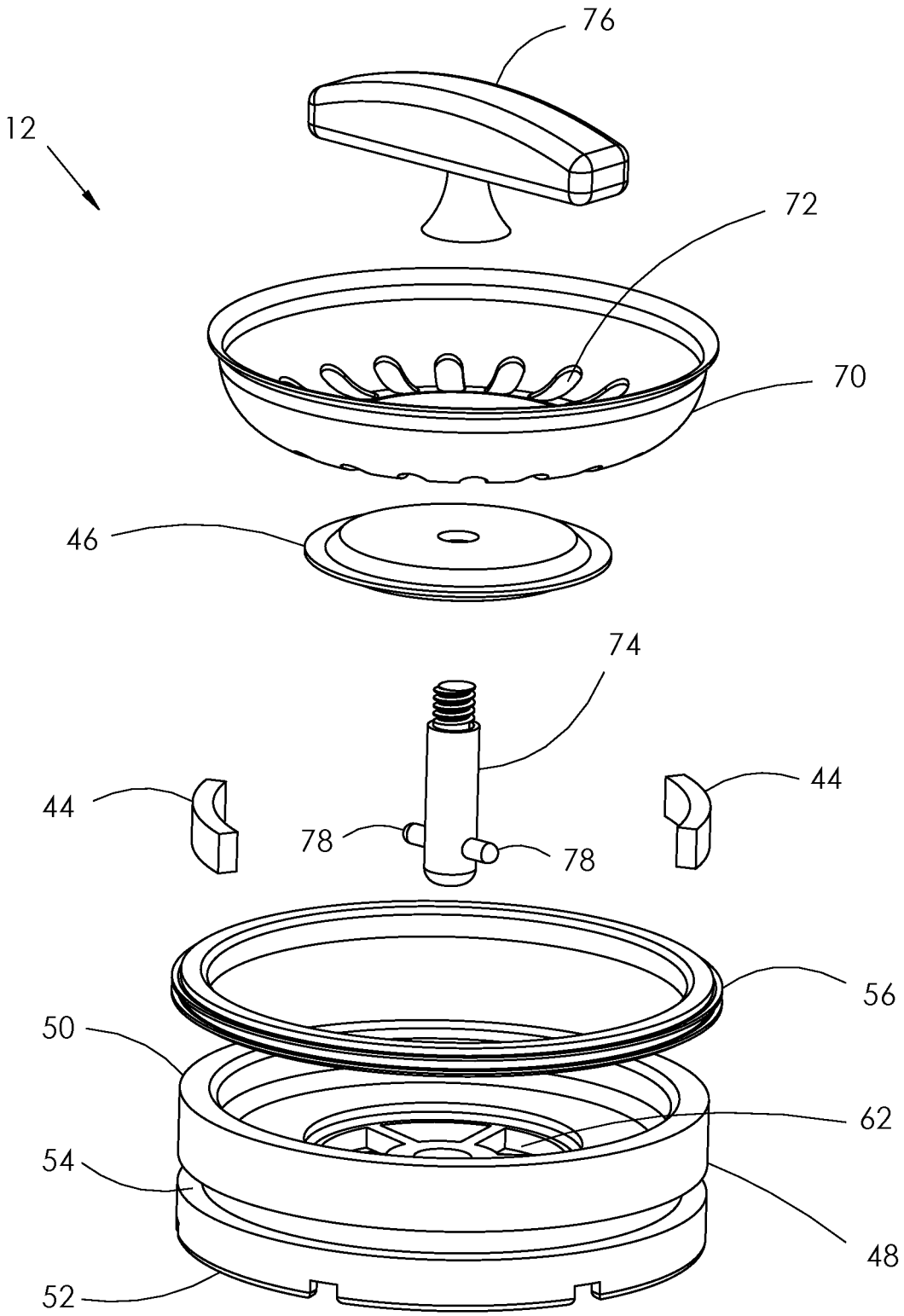
Figure 22:
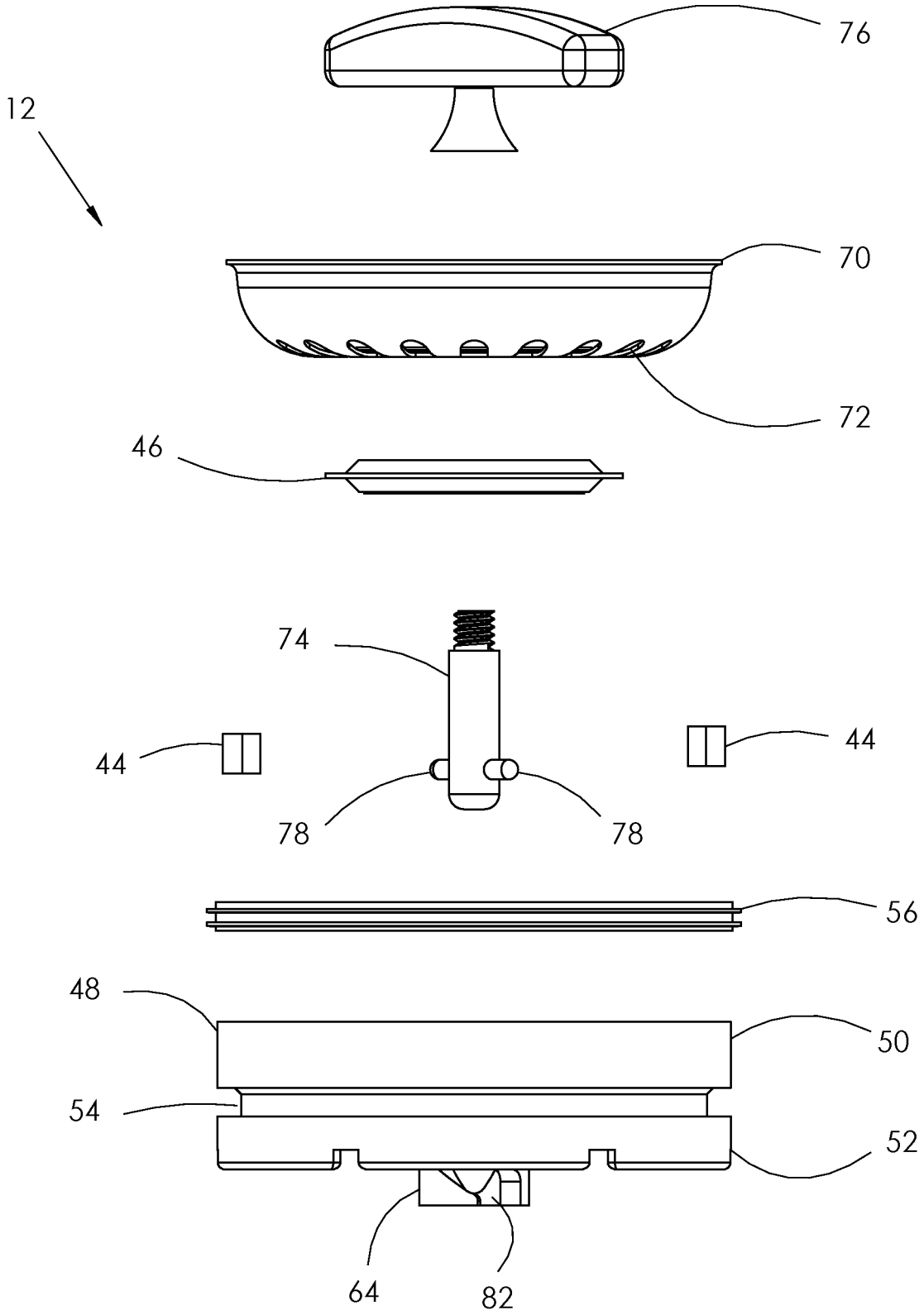
Figure 23:
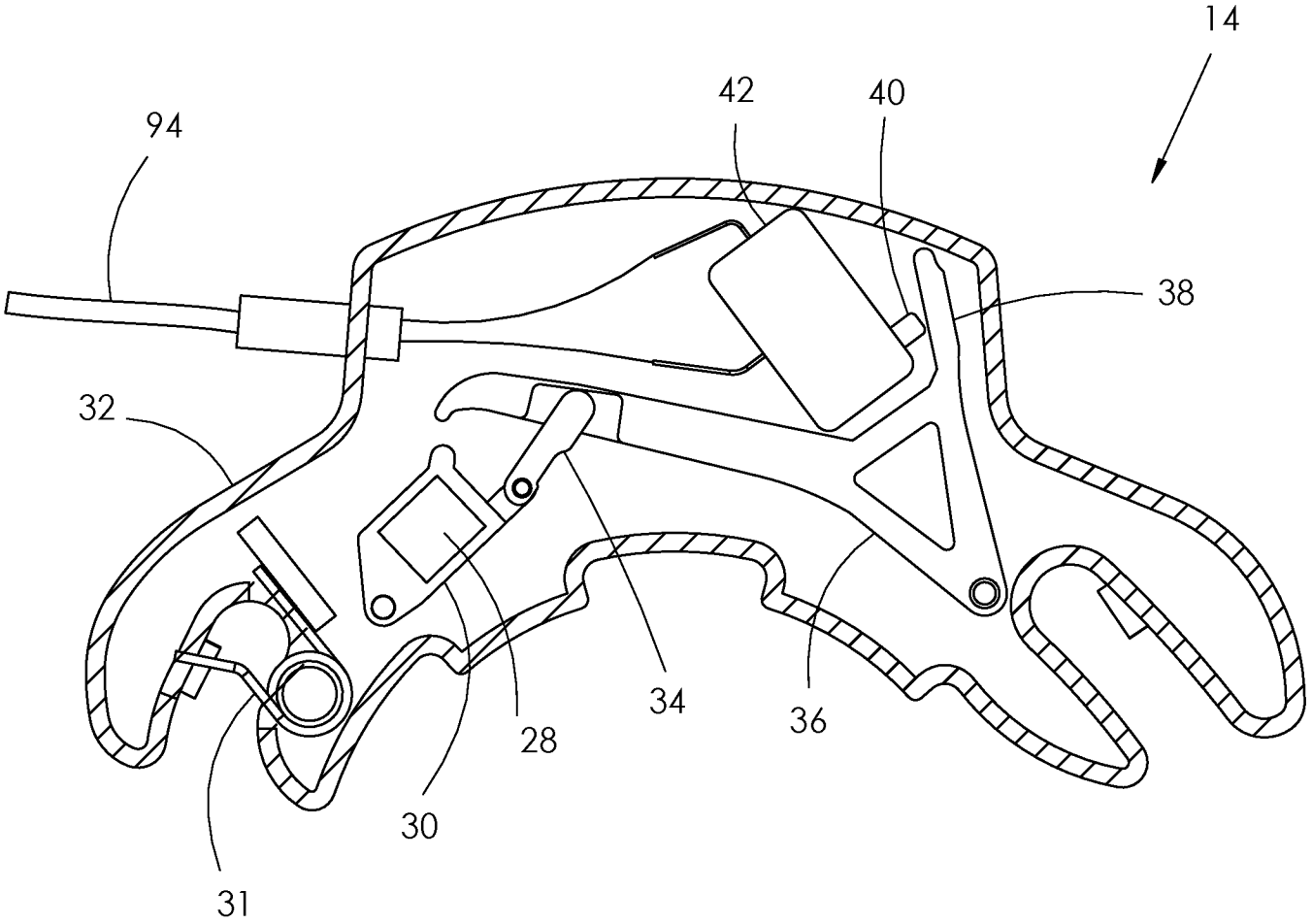
Figure 24:
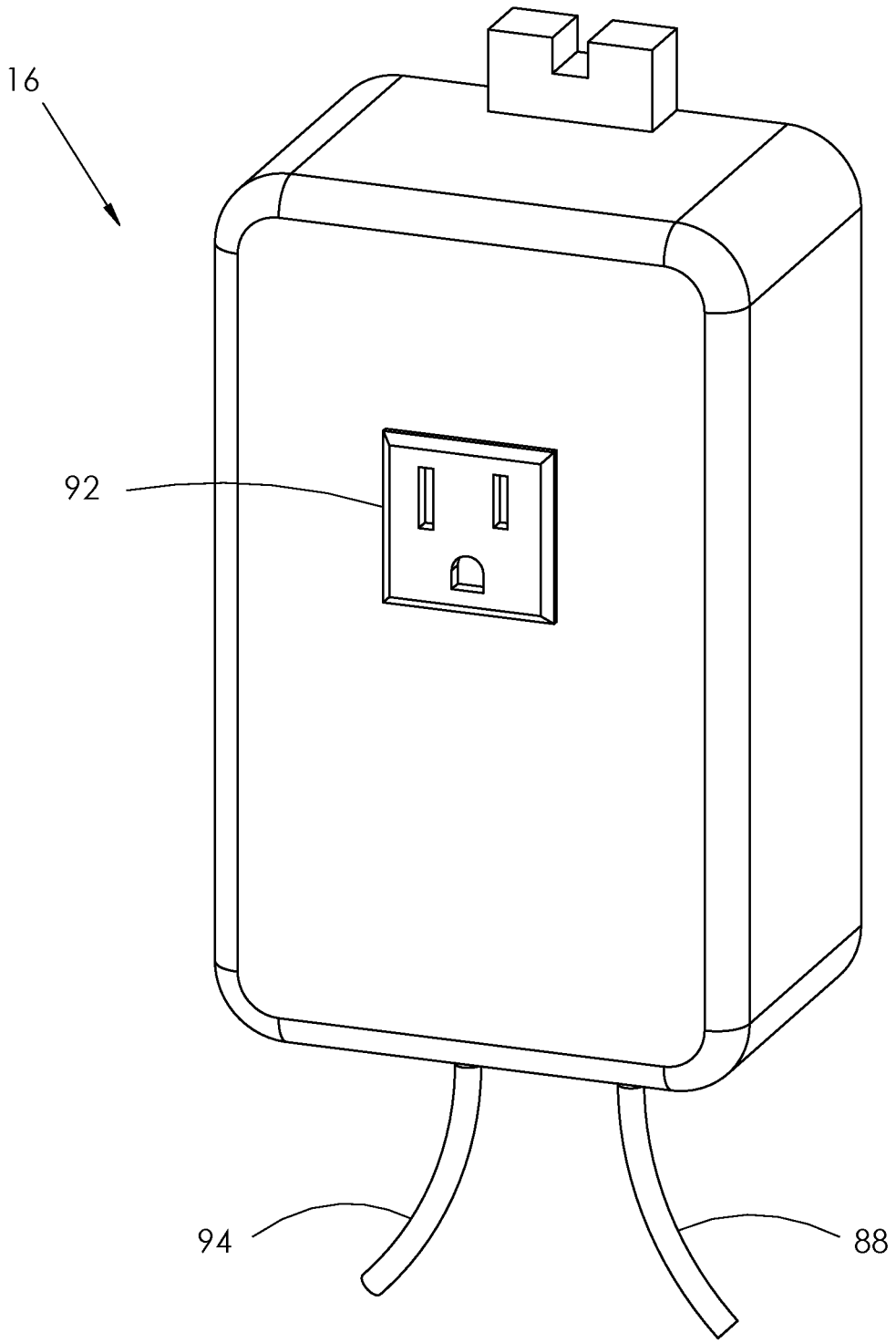
Figure 25:
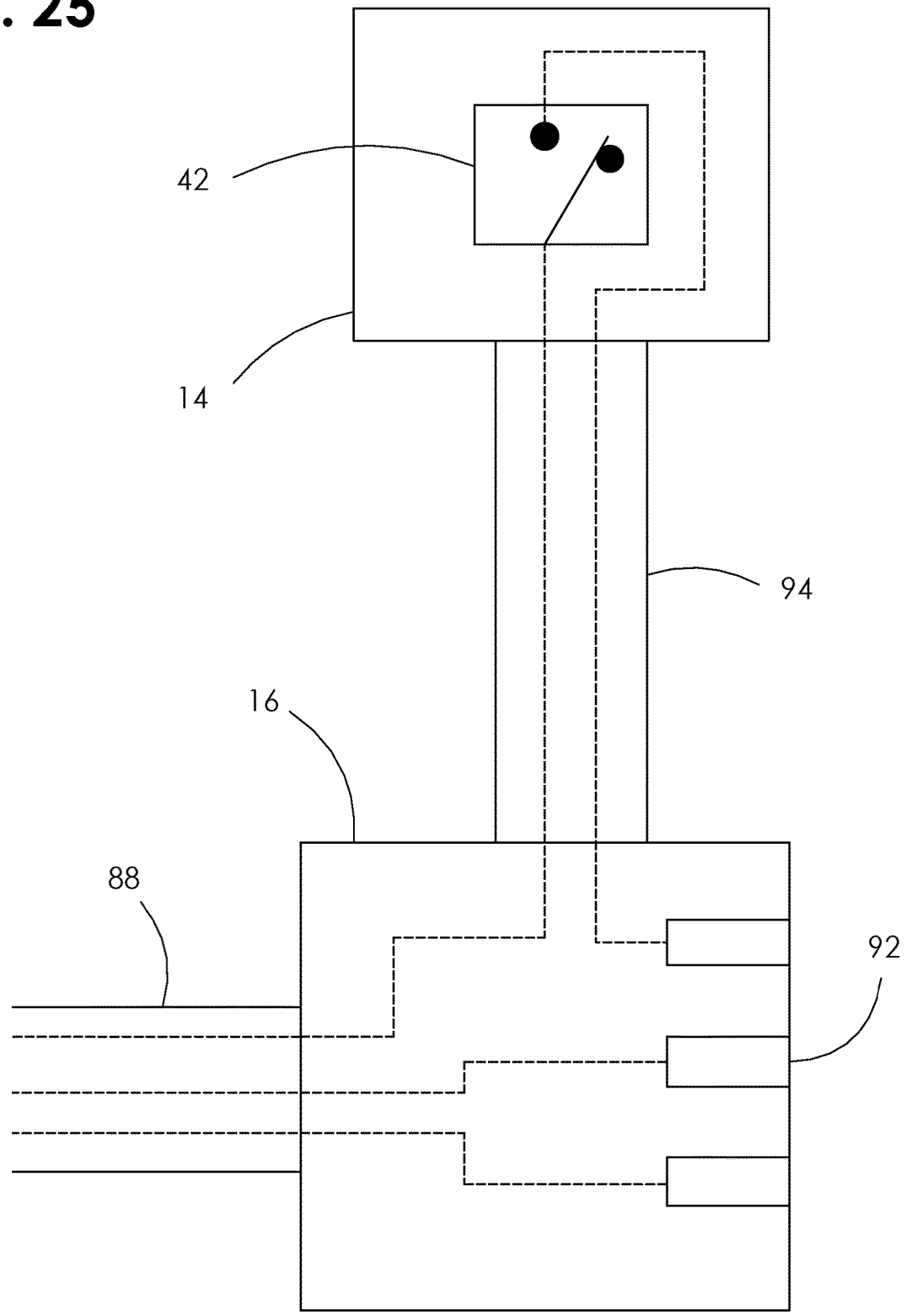
Figure 26:
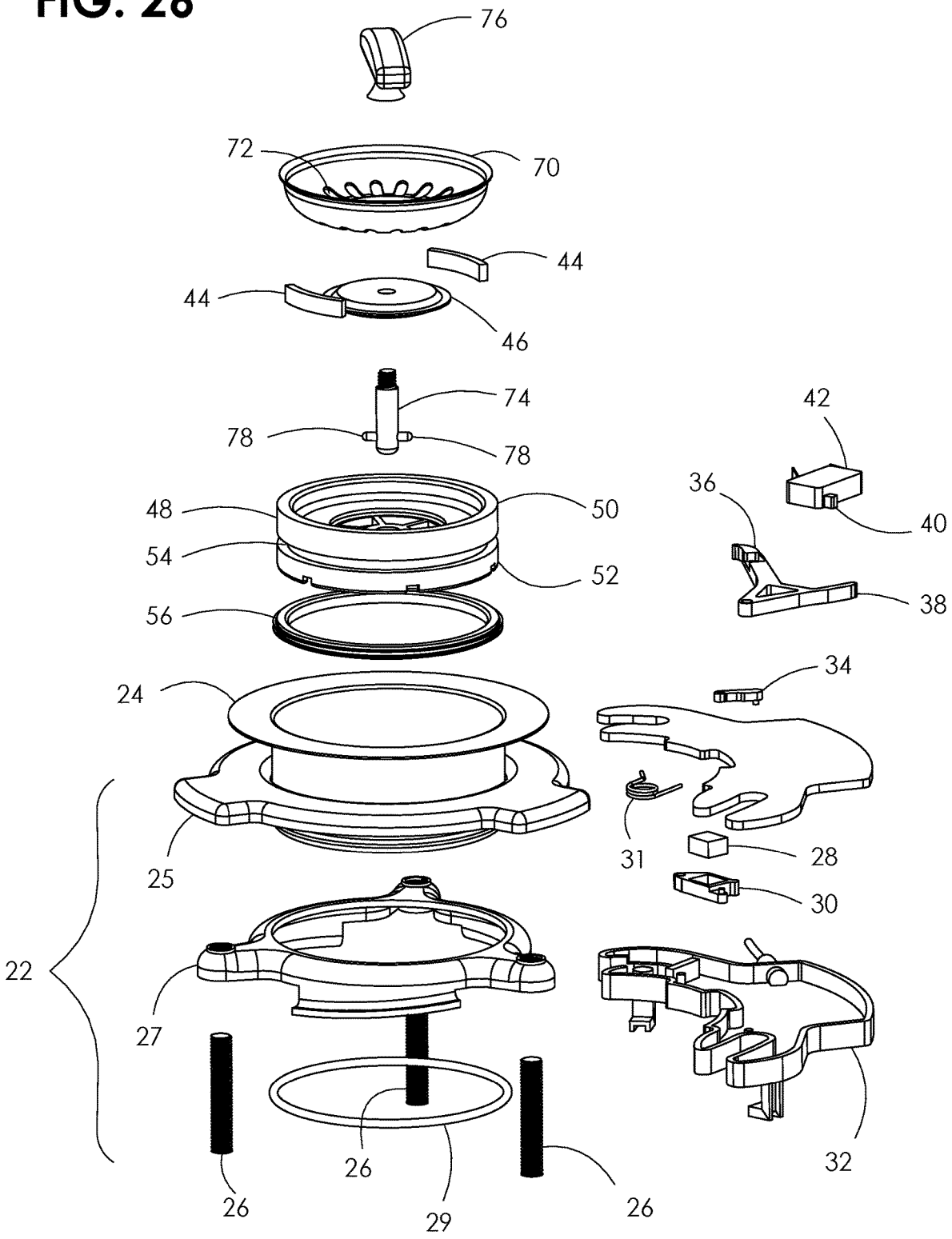
Figure 27:
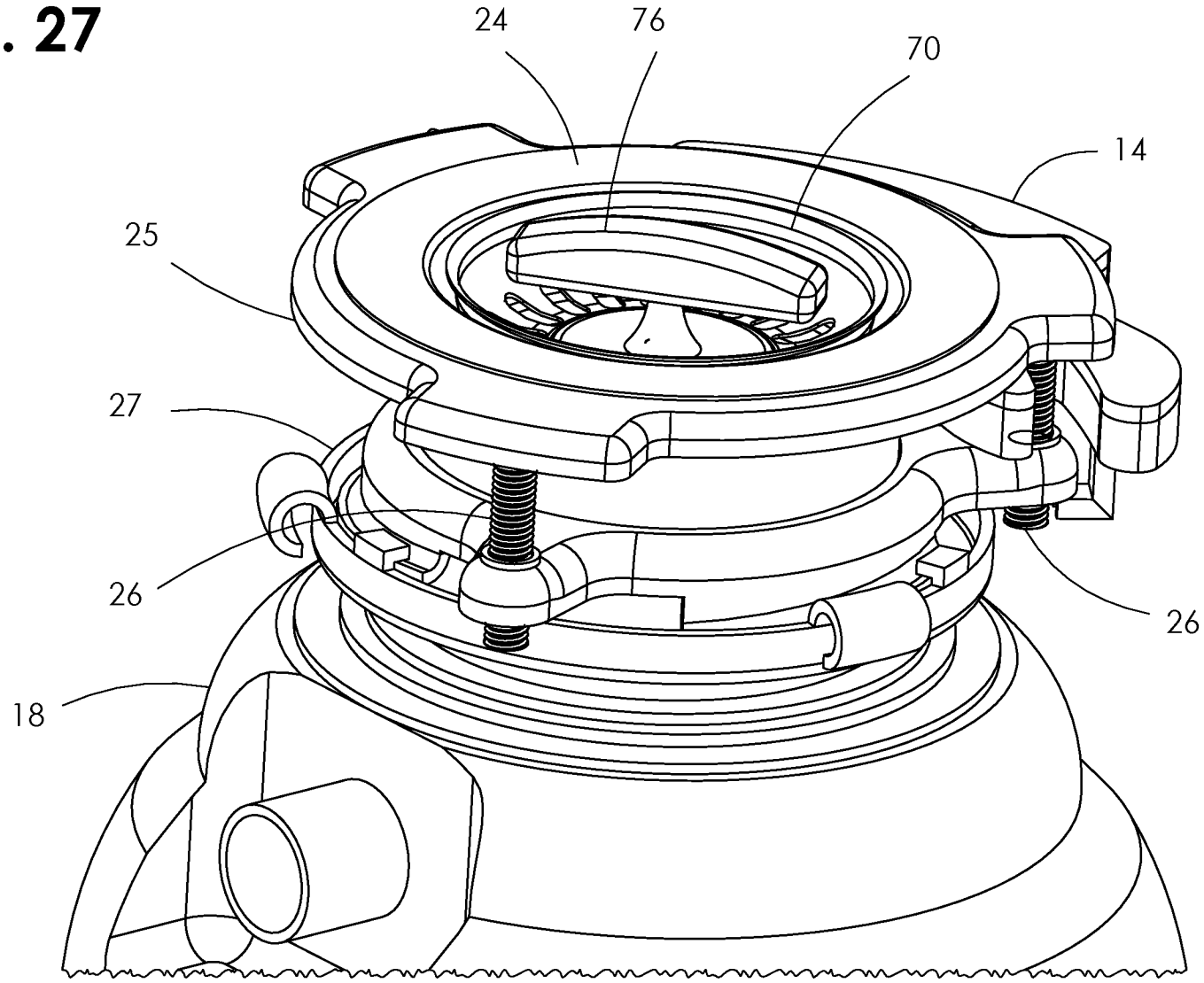
Figure 28:
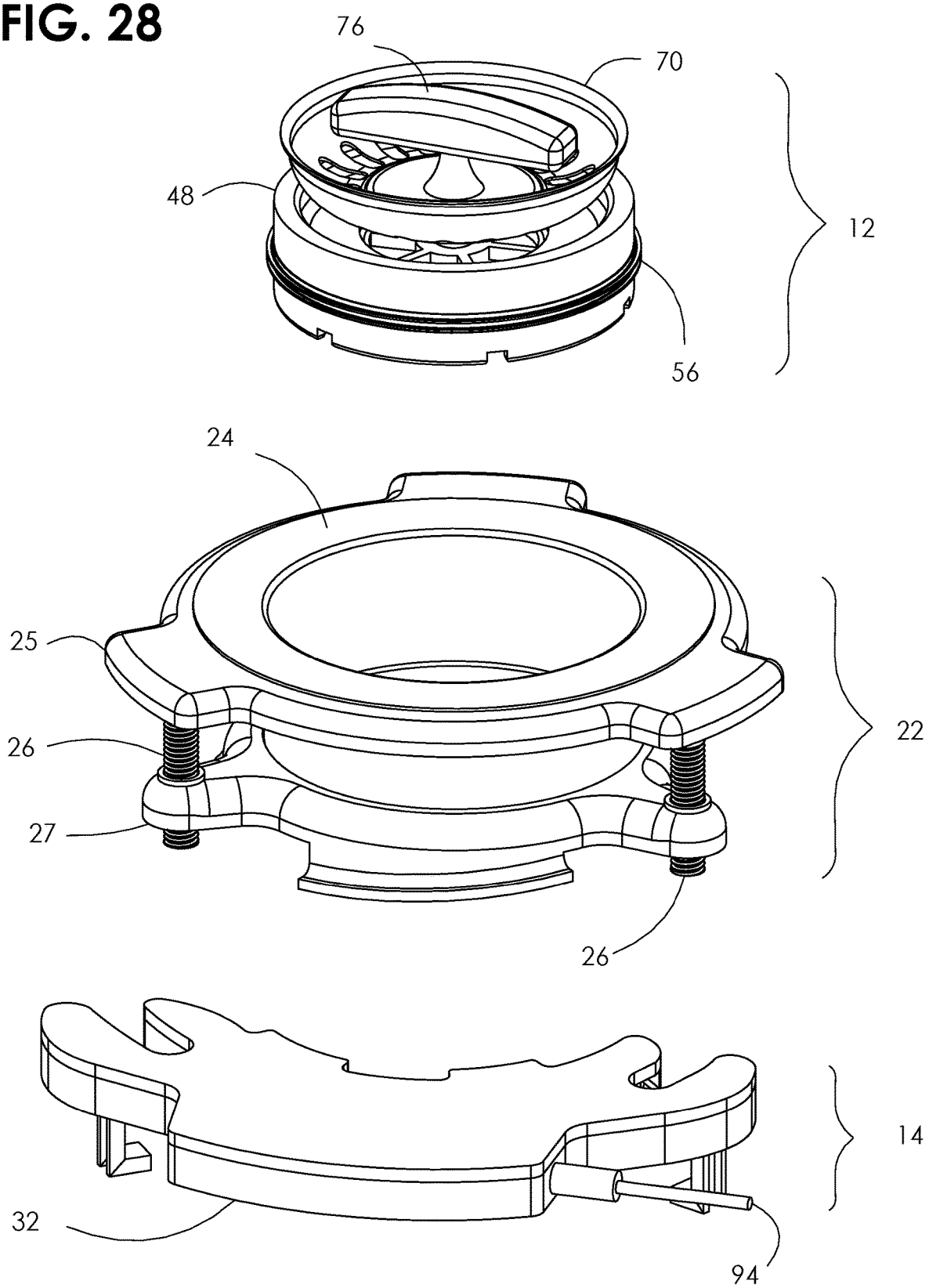
Figure 29:
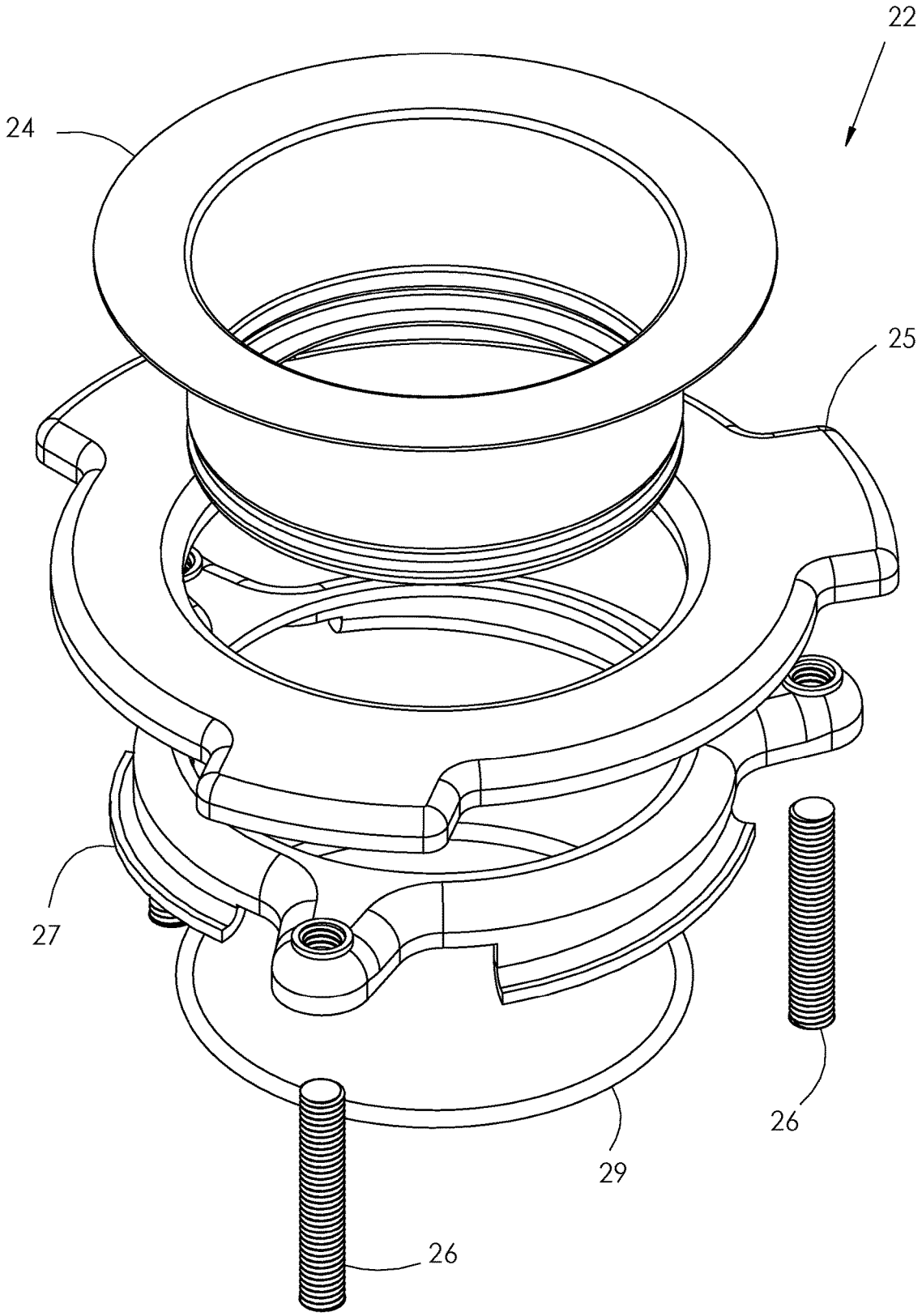

FIG. 6 is an exploded perspective view of the interlock assembly of FIG. 1, comprising the interlock device, the magnetically activated switch, and the electric circuit box FIG. 7 is a top perspective view of components of the interlock assembly of FIG. 1, comprising the interlock device and the magnetically activated switch adjacent one another, showing the magnetically activated switch as a cutaway view;

FIG. 8 is a top perspective combined partial section and cutaway view of components of the interlock assembly of FIG. 1, comprising the interlock device and the magnetically activated switch, showing the interlock device in a food waste disposer activation position, and showing the magnetically activated switch as a cutaway view;

FIG. 9 is a top partial section view of components of the interlock assembly of FIG. 1, comprising the interlock device and the magnetically activated switch, showing the interlock device in a food waste disposer activation position;

FIG. 10 is a top partial section view of components of interlock assembly of FIG. 1, comprising the interlock device and the magnetically activated switch, showing the interlock device in a position other than a food waste disposer activation position;

FIG. 11 is a top perspective view of the interlock device;

FIG. 12 is a combined partial section and cutaway view of the interlock device;

FIG. 13 is a bottom perspective view of the interlock device showing nubs of a spindle of the interlock device in a lowered position;

FIG. 14 is a bottom perspective view of the interlock device showing a nub of the spindle of the interlock device in a raised position;

FIG. 15 is a bottom view of the interlock device;

FIG. 16 is a side cross section view of the interlock device of FIG. 1, showing a spindle seal of the interlock device in a raised and open position allowing water and wastewater to flow through the interlock device;

FIG. 17 is another side cross section view of the interlock device, showing the spindle seal of the interlock device in a raised and open position, which allows water and wastewater to flow through the interlock device;

FIG. 18 is another side cross section view of the interlock device, showing the spindle seal of the interlock device in a raised, locked, and open position, which allows water and wastewater to flow through the interlock device;

FIG. 19 is a side cross section view of the interlock device of FIG. 1, showing the spindle seal of the interlock device in a lowered and closed position blocking water and wastewater from flowing through the interlock device;

FIG. 20 is another side cross section view of the interlock device, showing the spindle seal of the interlock device in a lowered and closed position, which blocks water and wastewater from flowing through the interlock device;

FIG. 21 is an exploded perspective view of the interlock device;

FIG. 22 is an exploded side view of the interlock device;

FIG. 23 a top cross section view of the magnetically activated switch of FIG. 1;

FIG. 24 is a perspective view of an electric circuit box for controlling and supplying power to the magnetically activated switch and the food waste disposer;

FIG. 25 is a schematic representation of the electrical circuitry of the electric circuit box of FIG. 24;

FIG. 26 is an exploded perspective view of components of the interlock assembly of FIG. 1, comprising the interlock device and the magnetically activated switch in more detail, also showing the flange and food waste disposer sink mount;

FIG. 27 is a perspective view of components of the interlock assembly of FIG. 1, comprising the interlock device seated within the flange and the magnetically activated switch fastened to the food waste disposer sink mount, showing the top of the food waste disposer;

FIG. 28 is an exploded perspective view of components of the interlock assembly of FIG. 1, comprising the interlock device and the magnetically activated switch, and showing the flange of the food waste disposer mounted within the food waste disposer sink mount; and FIG. 29 is an exploded perspective view of the food waste disposer sink mount, also showing the flange.

DESCRIPTION

The preferred embodiments of the present invention will be described with reference to FIGS. 1-29 of the drawings. Identical elements in the various figures are identified with the same reference numbers.

FIGS. 1-6 show components of an interlock assembly 10, comprising an interlock device 12, a magnetically activated switch 14, and an electric circuit box 16, constructed in accordance with the present invention, which may be used to convert a food waste disposer 18 from a continuous feed food waste disposer into a batch feed food waste disposer.

The food waste disposer 18 is typically fastened to a sink 20 with a food waste disposer sink mount 22, which has a flange 24, which may be used to removably and matingly receive and seat the interlock device 12 therein. The food waste disposer sink mount 22 is often a three hole mount for passing bolts 26 therethrough and fastening the food waste disposer 18 to the sink 20, although other suitable fastening arrangements may be used.

In more detail, an upper clamp ring 25 fits around the circumference of the flange 24 underneath the sink 20 and clamps the flange 24 securely to the sink 20 using three of the bolts 26. The bolts 26 are removably threaded through a lower mounting ring 27, which securely mounts the food waste disposer 18 beneath the flange 24. The lower mounting ring 27 is fastened to the flange 24 by a snap ring 29.

The magnetically activated switch 14 is fastened to the food waste disposer sink mount 22 adjacent the flange 24, using two of the bolts 26, although other suitable fastening arrangements may be used.

The electric circuit box 16, which is connected to an external power source, supplies electrical power to the magnetically activated switch 14. The food waste disposer 18 is activated and electrical power is supplied to the food waste disposer 18 by the magnetically activated switch 14, when the magnetically activated switch 14 is activated by the interlock device 12.

The interlock device 12 must be seated in the flange 24 and the interlock device 12 must be in a food waste disposer activation position for the food waste disposer 18 to be activated.

If the interlock device 12 is not seated in the flange 24 or if the interlock device is withdrawn from the flange 24, the food waste disposer 18 will not be activated. Likewise, the food waste disposer 18 will turn off, if the food waste disposer 18 is already turned on and the interlock device 12 ceases to be seated in the flange 24 or if the interlock device is withdrawn from the flange 24.

If the interlock device 12 is seated in the flange 24 and if the interlock device 12 is in a food waste disposer activation position, the food waste disposer 18 will be activated and electric power will be supplied to the food waste disposer by the electric circuit box 16.

The interlock assembly 10 may be used to retrofit an existing food waste disposer 18 and convert a continuous feed food waste disposer into a batch feed food waste disposer. Alternatively, the interlock assembly 10 may be used in a new batch feed waste disposer installation. The interlock assembly 10 may optionally be a kit.

FIGS. 7-10 show the interlock device 12 and the magnetically activated switch 14 adjacent one another and, in particular, FIGS. 9 and 10 show the interlock device 12 in a food waste disposer activation position and alternatively in a position other than a food waste disposer activation position, respectively.

The magnetically activated switch 14 has a magnetically activated switch magnet 28 seated in a magnetically activated switch magnet housing 30 that is pivotally connected to magnetically activated switch housing 32. The magnetically activated switch 14 has a first linkage 34 that is pivotally coupled to the magnetically activated switch magnet housing 30 and a second linkage 36 that is pivotally coupled to the first linkage 34. The second linkage 36 is also pivotally connected to the magnetically activated switch housing 32.

The second linkage 36 has a lever arm 38, which presses against spring loaded switch activator button 40 of spring activated switch 42 and activates the food waste disposer 18 by supplying electric power to the food waste disposer 18, when the magnetically activated switch magnet 28 is drawn to one of the interlock device magnets 44 of the interlock device 12.

The magnetically activated switch magnet 28 is drawn to one of the interlock device magnets 44, when the interlock device 12 is seated in the flange 24 and one of the interlock device magnets 44 is adjacent the magnetically activated switch magnet 28.

When the interlock device 12 is seated in the flange 24 and the interlock device 12 is in a food waste disposer activation position, the magnetically activated switch magnet 28 is adjacent one of the interlock device magnets 44 of the interlock device 12, and the magnetically activated switch magnet 28 is drawn to one of the interlock device magnets 44, which activates the food waste disposer 18.

Alternatively, when the interlock device 12 is not in a food waste disposer activation position, the magnetically activated switch magnet 28 is not adjacent one of the interlock device magnets 44 of the interlock device 12, and the spring activated switch 42 is switched off. When the spring activated switch 42 is switched off, the food waste disposer 18 is not activated or is deactivated if already turned on.

A mounting spring 31 is used to hold the magnetically activated switch housing 32 in place at one of the bolts 26.

FIGS. 11-22 show the interlock device 12 and, in particular, FIGS. 16-18 show a substantially disk shaped spindle mounted seal 46 of the interlock device 12 in a raised and open position, which allows water and wastewater to flow through the interlock device 12, and FIGS. 19 and 20 show the substantially disk shaped spindle mounted seal 46 of the interlock device 12 in a lowered and closed position, which blocks water and wastewater from flowing through the interlock device.

The interlock device 12 may be removably, matingly, and rotatably seated in and unseated from the flange 24. The interlock device 12 may, thus, be removed from the flange 24, in order to remove, for example, any collected debris from the interlock device 12, after which, the interlock device 12 can be reseated in the flange 24.

The interlock device 12 is substantially disk shaped and has a substantially disk shaped base 48 having:

an upper cylindrical outer collar 50, a lower cylindrical outer collar 52, and an outer groove 54 therebetween having a flange seal 56, which creates a seal between the interlock device 12 and the flange 24, an upper substantially centrally disposed recessed seat 58 having a substantially centrally disposed bore 60 therethrough and a plurality of base holes 62 surrounding the substantially centrally disposed bore 60, opposing interlock device magnets 44 adjacent periphery 62 of the substantially disk shaped base 48;

a lower substantially centrally disposed tubular helical cam 64 adjoined to the substantially disk shaped base 48 having:

opposing longitudinal helical grooves 66 having upper bayonet locks 68, the substantially centrally disposed bore 60 extending through the lower substantially centrally disposed tubular helical cam 64, an upper strainer basket 70 having:

a plurality of upper strainer basket drain holes 72, a lower substantially centrally disposed spindle 74 rotatably mounted through the substantially disk shaped base 48 and the substantially centrally disposed bore 60, the lower substantially centrally disposed spindle 74 adjoined to the upper strainer basket 70 and having an upper handle 76 adjoined thereto, the lower substantially centrally disposed spindle 74 having opposing nubs 78, which travel within the opposing longitudinal helical grooves 66, which act as guides for the opposing nubs 78, when the upper handle 76 is rotatably twisted, a substantially disk shaped spindle mounted seal 46 adapted to block any fluid, water, waste, or wastewater from flowing through the interlock device, when:

the substantially disk shaped spindle mounted seal 46 is releasably seated in the upper substantially centrally disposed recessed seat 58, when the substantially disk shaped spindle mounted seal 46 is lowered into the upper substantially centrally disposed recessed seat 58 by rotatably twisting the upper handle 76, forcing the opposing nubs 78 to travel downwards to the bottom 82 of the opposing longitudinal helical grooves 66 and block any fluid, water, waste, or wastewater from flowing through the interlock device 12, the substantially disk shaped spindle mounted seal 46 allowing fluid, water, or wastewater to flow through the interlock device 12, when:

the substantially disk shaped spindle mounted seal 46 is releasably unseated from the upper substantially centrally disposed recessed seat 58, when the substantially disk shaped spindle mounted seal 46 is raised from the upper substantially centrally disposed recessed seat 58 by rotatably twisting the upper handle 76, forcing the opposing nubs 78 to travel upwards from the bottom 82 of the opposing longitudinal helical grooves 66 and allow fluid, water, or wastewater to flow through the interlock device 12;

a magnetically activated switch 14 coupled to the flange 24, the magnetically activated switch 14 having a magnetically activated switch magnet 28, the magnetically activated switch 14 activating the food waste disposer 18 when the interlock device 12 is seated in the flange 24 in a food waste disposer activation position, which exists when one of the opposing interlock device magnets 44 is adjacent the magnetically activated switch magnet 28, the magnetically activated switch 14 deactivating the food waste disposer 18 when the interlock device 12 is seated in the flange 24 in a position other than the food waste disposer activation position, which exists when one of the opposing interlock device magnets 44 is not adjacent the magnetically activated switch magnet 28, the magnetically activated switch 14 deactivating the food waste disposer 18 when the interlock device 12 is unseated or removed from the flange 24.

The opposing interlock device magnets 44 are preferably arcuate shaped or C-shaped and are preferably embedded in the upper cylindrical outer collar 50 of the substantially disk shaped base 48 of the interlock device 12, although other suitable shaped magnets and locations adjacent the periphery of the upper cylindrical outer collar 50 or adjacent the periphery of the disk shaped base 48 may be used.

FIG. 23 shows the magnetically activated switch 14. Now, again the magnetically activated switch 14 has the magnetically activated switch magnet 28 seated in the magnetically activated switch magnet housing 30 that is pivotally connected to the magnetically activated switch housing 32. The magnetically activated switch 14 has the first linkage 34 that is pivotally coupled to the magnetically activated switch magnet housing 30 and the second linkage 36 that is pivotally coupled to the first linkage 34. The second linkage 36 is also pivotally connected to the magnetically activated switch housing 32.

The second linkage 36 has the lever arm 38, which presses against the spring loaded switch activator button 40 of the spring activated switch 42 and activates the food waste disposer 18 by supplying electric power to the food waste disposer 18, when the magnetically activated switch magnet 28 is drawn to one of the opposing interlock device magnets 44 of the interlock device 12.

The magnetically activated switch magnet 28 is drawn to one of the opposing interlock device magnets 44, when the interlock device 12 is seated in the flange 24 and one of the interlock device magnets 44 is adjacent the magnetically activated switch magnet 28.

When the interlock device 12 is seated in the flange 24 and the interlock device 12 is in a food waste disposer activation position, the magnetically activated switch magnet 28 is adjacent one of the opposing interlock device magnets 44 of the interlock device 12, and the magnetically activated switch magnet 28 is drawn to one of the opposing interlock device magnets 44, which activates the food waste disposer 18.

Alternatively, when the interlock device 12 is not in a food waste disposer activation position, the magnetically activated switch magnet 28 is not adjacent one of the opposing interlock device magnets 44 of the interlock device 12, and the spring activated switch 42 is switched off. When the spring activated switch 42 is switched off, the food waste disposer 18 is not activated or is deactivated if already turned on.

The food waste disposer sink mount 22 is often a three hole mount for passing the bolts 26 therethrough and fastening the food waste disposer 18 to the sink 20, although other suitable fastening arrangements may be used.

The magnetically activated switch 14 is fastened to the food waste disposer sink mount 22 adjacent the flange 24, using two of the bolts 26 that are used to fasten the food waste disposer 18 to the sink 20, using the food waste disposer sink mount 22.

FIGS. 24 and 25 show the electric circuit box 16 for controlling and supplying electric power to the magnetically activated 14 and the food waste disposer 18 and the electric circuitry of the electric circuit box 16, respectively. Electric power cable 88, which is connected to an external electric power source, is used to supply electric power to the electric circuit box 16. A cable 94 from the magnetically activated switch 14 supplies electric power to the receptacle 92 of the electric circuit box 16, when the magnetically activated switch 14 is activated. Food waste disposer cable 90, which plugs in to the receptacle 92 of the electric circuit box 16, is used to supply electric power from the electric circuit box 16 to the food waste disposer 18, when the magnetically activated switch 14 is activated.

FIG. 26 shows an exploded perspective view of components of the interlock assembly 10, comprising the interlock device 12 and the magnetically activated switch 14 in more detail, also showing the flange 24 and food waste disposer sink mount 22.

FIG. 27 shows components of the interlock assembly 10, comprising the interlock device 12 seated within the flange 24 and the magnetically activated switch 14 fastened to the food waste disposer sink mount 22, showing the top of the food waste disposer 18.

FIG. 28 shows components of the interlock assembly 10, comprising the interlock device 12 and the magnetically activated switch 14, and showing the flange 24 of the food waste disposer 18 mounted within the food waste disposer sink mount 22.

FIG. 29 shows the food waste disposer sink mount 22, showing the flange 24 and the bolts 26.

Although the present invention has been described in considerable detail with reference to certain preferred versions thereof, other versions are possible. Therefore, the spirit and scope of the appended claims should not be limited to the description of the preferred versions contained herein.

What is claimed is:

1. A food waste disposer interlock device, comprising:

a cylindrical housing having:

an interior cylindrical wall and an exterior cylindrical wall, an upper cylindrical open chamber and a lower cylindrical open chamber having a first disk therebetween which is adjoined to said interior cylindrical wall, a lower central hub, said first disk having:

an upper surface, a first bore having an upper edge, a fluid entrance, a lower edge, and an intermediate surface between said upper edge and said lower edge, a plurality of radial spokes adjoined to said lower central hub and said lower edge, a plurality of drain holes between said plurality of radial spokes, said lower central hub, and said lower edge, each drain hole of said plurality of drain holes having a shape defined by adjacent radial spokes of said plurality of radial spokes, a first arc defined by said lower central hub, and a second arc defined by said lower edge, said lower central hub having a second bore and a locking helical cam having opposing helical grooves;

opposing arcuate food waste disposer activation magnets embedded in said cylindrical housing between said interior cylindrical wall and said exterior cylindrical wall, said opposing arcuate food waste disposer activation magnets used to activate a food waste disposer, when said opposing arcuate food waste disposer activation magnets are coupled to said food waste disposer;

a strainer basket having:

a second disk, an arcuate shaped strainer contiguous with and surrounding said second disk and having a plurality of radial strainer holes, a lower shaft having lower opposing nubs, an upper handle fastened to said lower shaft and said second disk, a stepped disk shaped seal fastened to said lower shaft beneath said second disk, said stepped disk shaped seal having an upper disk shaped seal portion, a lower disk shaped seal portion, and a central disk shaped seal portion therebetween extending outwardly beyond said upper disk shaped seal portion and said lower disk shaped seal portion, said stepped disk shaped seal adapted to seat on said upper surface and said intermediate surface, said lower opposing nubs travelling within said opposing helical grooves and having a top of travel, a bottom of travel, and an intermediate position, when said upper handle is rotated, said stepped disk shaped seal lowered, compressed, and sandwiched between said first disk and said second disk when said lower opposing nubs are rotated to said bottom of travel, which prevents fluid flow through said food waste disposer interlock device, said stepped disk shaped seal raised above said first disk when said lower opposing nubs are rotated to said top of travel, which allows fluid flow through said food waste disposer interlock device, said stepped disk shaped seal raised above said first disk when said lower opposing nubs are rotated to said intermediate position, which allows partial fluid flow through said food waste disposer interlock device.

* * * * *